United States Patent [19]

Umemoto et al.

[11] Patent Number: 4,748,100

[45] Date of Patent: May 31, 1988

[54] MULTILAYER SILVER HALIDE COLOR PHOTOGRAPHIC LIGHT-SENSITIVE MATERIAL CONTAINING A NOVEL COMBINATION OF COUPLERS

[75] Inventors: Makoto Umemoto; Kozo Aoki, both of Kanagawa, Japan

[73] Assignee: Fuji Photo Film Co., Ltd., Kanagawa, Japan

[21] Appl. No.: 97,336

[22] Filed: Sep. 11, 1987

Related U.S. Application Data

[63] Continuation of Ser. No. 729,841, May 2, 1985, abandoned.

[30] Foreign Application Priority Data

May 2, 1984 [JP] Japan ..... 59-89720

[51] Int. Cl.[4] ..... G03C 1/46; G03C 1/08; G03C 7/26; G03C 7/32

[52] U.S. Cl. ..... 430/505; 430/512; 430/551; 430/552; 430/553; 430/554; 430/555; 430/556; 430/557; 430/558

[58] Field of Search ..... 430/505, 512, 551, 552, 430/553, 554, 555, 556, 557, 558

[56] References Cited

U.S. PATENT DOCUMENTS

| | | | |
|---|---|---|---|
| 4,239,843 | 12/1980 | Hara et al. | 430/554 X |
| 4,360,589 | 11/1982 | Kojima et al. | 430/554 X |
| 4,430,425 | 2/1984 | Lepparad | 430/554 X |
| 4,456,681 | 6/1984 | Kadowaki et al. | 430/505 |
| 4,524,132 | 6/1985 | Aoki et al. | 430/554 X |
| 4,536,472 | 8/1985 | Kato et al. | 430/505 |
| 4,540,656 | 9/1985 | Nishizima et al. | 430/505 |

OTHER PUBLICATIONS

Research Disclosure #20525, pp. 184–187, May 1981.

*Primary Examiner*—Mukund J. Shah
*Attorney, Agent, or Firm*—Sughrue, Mion, Zinn, Macpeak, and Seas

[57] ABSTRACT

A silver halide color photographic light-sensitive material comprising a support having formed thereon at least one red-sensitive emulsion layer, at least one green-sensitive emulsion layer, and at least one blue-sensitive emulsion layer is disclosed. The material cotains a novel combination of cyan, magenta, and yellow couplers and has improved color forming properties, color reproducibility, and image preservability.

29 Claims, No Drawings

MULTILAYER SILVER HALIDE COLOR PHOTOGRAPHIC LIGHT-SENSITIVE MATERIAL CONTAINING A NOVEL COMBINATION OF COUPLERS

This is a continuation of application Ser. No. 729,841, filed May 2, 1985, now abandoned.

FIELD OF THE INVENTION

This invention relates to a multilayer silver halide color light-sensitive material, and, more particularly, to a multilayer silver halide color light-sensitive material containing a novel combination of couplers, which has improved color forming properties, improved color reproducibility, improved image preservability, and stabilized color balance.

BACKGROUND OF THE INVENTION

Silver halide color light-sensitive materials comprise a support having provided thereon a multiple light-sensitive layer composed of three kinds of silver halide emulsion layers which have been selectively sensitized so as to have sensitivity to blue light, green light, and red light. For example, so-called color papers generally comprise a support having coated thereon a red-sensitive emulsion layer, a green-sensitive emulsion layer, and a blue-sensitive emulsion layer in sequence from the side intended to be exposed to light. An intermediate layer for preventing color mixing or ultraviolet absorption or a protective layer is also provided between the light-sensitive layers or on the outermost surface.

So-called color positive films generally comprise a support having coated thereon a green-sensitive emulsion layer, a red-sensitive emulsion layer, and a blue-sensitive emulsion layer in sequence from the side intended to be exposed to light. Color negative films can have various layer arrangements, and generally comprise a blue-sensitive emulsion layer, a green-sensitive emulsion layer, and a red-sensitive emulsion layer in sequence from the side intended to be exposed to light. In some of light-sensitive materials having two or more emulsion layers sensitive to the same color but differing in sensitivity, said emulsion layers have interposed therebetween an emulsion layer having different color sensitivity and further inserted therebetween a yellow filter layer, an intermediate layer, or the like, and a protective layer may be coated on the outermost surface.

Color image formation is achieved by incorporating three photographic couplers including yellow, magenta, and cyan couplers in the light-sensitive layer and subjecting an exposed light-sensitive material to color development processing with the so-called color developing agent. It is desirable that the rate of coupling between an oxidized product of an aromatic primary amine developing agent and a coupler to develop a color should be as high as possible so as to produce a high color density within a limited development time, i.e., the coupler desirably exhibits a satisfactory color forming property. Further, the color formers are required to be distinct cyan, magenta, or yellow dyes with less side absorption and to provide color photographic images having satisfactory color reproducibility.

On the other hand, the thus formed color photographic images are required to exhibit good preservability under various conditions. It is important in order to fulfill this requirement that the rate of decoloration or discoloration of each color former being different in hue is low, and that the rate of discoloration is as uniform as possible over the entire image density area so that the color balance of the remaining dye image does not change.

Conventional light-sensitive materials, particularly color papers, undergo great deterioration of cyan dye images due to dark decoloration caused by humidity and heat over a long period of time, which is likely to result in color balance variation. Therefore, improvement of cyan dye decoloration has been keenly desired. In the prior art, light-sensitive materials that are resistant to dark decoloration are inferior in hue and provide a cyan dye image which is susceptible to discoloration or decoloration due to light. Development of novel combinations of couplers providing improved properties has, therefore, long been desired.

In order to partially overcome the above-described problem, several specific combinations of couplers have been proposed, as disclosed, e.g., in Japanese Patent Publication No. 7344/77, Japanese Patent Application (OPI) Nos. 20037/82, 57238/84 and 160141/84 (the term "OPI" as herein used means "unexamined published application"). However, these combinations are still somewhat unsatisfactory because of insufficient color forming property, poor hue of the developed color, and the like, thereby adversely affecting color reproduction, particularly causing color balance variation of the remaining dye image with deterioration due to light or heat.

SUMMARY OF THE INVENTION

Accordingly, the present invention aims at overcoming the above-described problems.

An object of this invention is to provide a silver halide color photographic light-sensitive material containing a novel combination of cyan, magenta, and yellow couplers, by which the couplers exhibit satisfactory color forming property, and the resulting color photographic image realizes improved color reproduction and preservability. In particular, a color image produced with such photographic material is free from variation of color balance for an extended period of time either in dark or light conditions.

Another object of this invention is to provide a silver halide color photographic light-sensitive material which exhibits excellent image preservability, and, particularly, which does not change its color balance not only in the high-density areas, but also in gradation areas, even after preservation for a long period of time in an atmosphere of high temperature and/or high humidity.

The above-described objects can be accomplished by a silver halide color light-sensitive material comprising a support having provided thereon a red-sensitive emulsion layer, a green-sensitive emulsion layer, and a blue-sensitive emulsion layer, wherein a coupler represented by formula (I), a coupler represented by formula (II) or (III), and a coupler represented by formula (IV) are contained in light-sensitive layers having sensitivities to different colors:

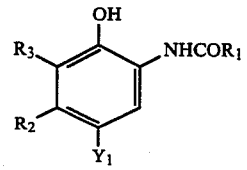

(I)

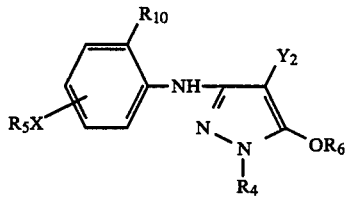

(II)

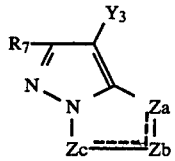

(III)

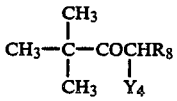

(IV)

wherein $R_1$ represents a substituted or unsubstituted aliphatic group, a substituted or unsubstituted aryl group, or a substituted or unsubstituted heterocyclic group; $R_2$ represents a substituted methyl group (the substituted methyl group includes an alkyl group having two or more carbon atoms); $R_3$ represents a hydrogen atom, a halogen atom, or a substituted or unsubstituted alkyl, aryl, alkoxy, or acylamino group; $R_4$ represents a substituted or unsubstituted phenyl group; $R_5$ represents a substituted or unsubstituted aryl group, a substituted or unsubstituted alkyl group or an aryloxyalkyl group having an aryl moiety substituted with an alkyl group, a halogen atom, an alkoxy group, an aryloxy group, an acylamino group, a sulfonamido group, an amino group, an aryl group, an aliphatic or aromatic sulfonyl group, a cyano group or a nitro group; $R_6$ represents a hydrogen atom, an acyl group or an aliphatic or aromatic sulfonyl group; $R_{10}$ represents a halogen atom or an alkoxy group; X represents a divalent linking group or atom; $R_7$ represents a hydrogen atom or an organic residual group bonded by carbon, oxygen, sulfur, nitrogen, phosphorus or silicon, preferably a substituted or unsubstituted aliphatic group or substituted or unsubstituted acryl group having 1 to 30 carbon atoms; $R_8$ represents a substituted or unsubstituted N-phenylcarbamoyl group; $Z_a$, $Z_b$, and $Z_c$ each represents a methine group, a substituted methine group, =N—, or —NH—; $Y_1$, $Y_2$, $Y_3$, and $Y_4$ each represents a hydrogen atom or a group releasable upon coupling with an oxidized product of a developing agent; and $R_2$, $R_3$, or $Y_1$ in formula (I), $R_4$, $R_5$, or $Y_2$ in formula (II), $R_7$, $Y_3$, or the methine group as represented by $Z_a$, $Z_b$, or $Z_c$ in formula (III), or $R_8$ or $Y_4$ in the formula (IV) may form a dimer or a higher polymer. The above-recited aliphatic groups may be straight or branched or cyclic and may be saturated or unsaturated.

In formula (I), the aliphatic group as represented by $R_1$ may be either straight or cyclic and may be either saturated or unsaturated, and preferably contains from 1 to 32 carbon atoms. Typical examples therefor include a methyl group, a butyl group, a hexadecyl group, an allyl group, a cyclohexyl group, a propenyl group, a propargyl group, and the like. The aryl group for $R_1$ typically includes a phenyl group and a naphthyl group. The heterocyclic group for $R_1$ typically includes a 2-pyridyl group, a 2-furyl group, a 6-quinolyl group, and the like. These groups can have one or more substituents. Suitable substituents include an aliphatic group (e.g., a methyl group, an allyl group, a cyclopentyl group, etc.), an aromatic group (e.g., a phenyl group, a naphthyl group, etc.), a heterocyclic group (e.g., a 2-pyridyl group, a 2-imidazolyl group, a 2-furyl group, a 6-quinolyl group, etc.), an aliphatic oxy group (e.g., a methoxy group, a 2-methoxyethoxy group, a 2-propenyloxy group, etc.), an aromatic oxy group (e.g., 2,4-di-tertamylphenoxy group, a 4-cyanophenoxy group, a 2-chlorophenoxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluenesulfonyloxy group, etc.), an amido group (e.g., an acetylamino group, a methanesulfonamido group, an ethylcarbamoyl group, a diethylcarbamoyl group, a butylsulfamoyl group, etc.), an imido group (e.g., a succinimido group, a hydantoinyl group, etc.), an ureido group (e.g., a phenylureido group, a dimethylureido group, etc.), an aliphatic or aromatic sulfonyl group (e.g., a methanesulfonyl group, a phenylsulfonyl group, etc.), an aliphatic or aromatic thio group (e.g., a phenylthio group, an ethylthio group, etc.), a hydroxyl group, a cyano group, a carboxyl group, a nitro group, a sulfo group, and a halogen atom (e.g., a fluorine atom, a chlorine atom, a bromine atom, etc.). When two or more substituents are present, they may be the same or different.

$R_2$ represents a methyl group having a substituent selected from those acceptable for $R_1$.

The alkyl, aryl, alkoxy, or acylamino group for $R_3$ may be substituted with a substituent selected from those acceptable for $R_1$.

Among the above-enumerated groups for $R_1$, those preferred are substituted or unsubstituted alkyl groups, with substituted aryloxyalkyl groups being particularly preferred.

$R_2$ preferably includes an alkyl group having 2 or more carbon atoms and an alkyl group (preferably a methyl group) substituted with an aryl group, an alkoxy group, an aryloxy group, an acylamino group, an alkylthio group, an arylthio group, an alkylsulfonyl group, an arylsulfonyl group, or an arylseleno group.

$R_3$ preferably includes a hydrogen atom and a halogen atom.

In the above-described formulae (I), (II), (III) and (IV), the group releasable upon coupling (hereinafter referred to as "a releasable group", often referred to as "split-off group" elsewhere) as represented by $Y_1$, $Y_2$, $Y_3$ or $Y_4$ includes a halogen atom, an aromatic azo group, and a group that connects a coupling active carbon and an aliphatic group, an aromatic group, a heterocyclic group, an aliphatic, aromatic, or heterocyclic sulfonyl group, or an aliphatic, aromatic, or heterocyclic carbonyl group via an oxygen, nitrogen, sulfur, or carbon atom. The aliphatic, aromatic, or heterocyclic group contained in these releasable groups may be substituted with the same substituents as noted above with respect to $R_1$. When they are substituted with two or more substituents, these substituents may be the same or different. These substituents may further be substituted with substituents as noted above with respect to $R_1$ (hereinafter referred to as "acceptable" substituents).

Specific examples of the coupling-releasable groups are a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), an aliphatic or aromatic sulfonyloxy group (e.g., a methanesulfonyloxy group, a toluenesulfonyloxy group, etc.), an acylamino group (e.g., a dichloroacetylamino group, a heptafluorobutyrylamino group, etc.), an aliphatic or aromatic sulfonamido group (e.g., a methanesulfonamino group, a p-toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic, aromatic or heterocyclic thio group (e.g., an ethylthio group, a phenylthio group, a tetrazolylthio group, etc.), a carbamoylamino group (e.g., an N-methylcarbamoylamino group, an N-phenylcarbamoylamino group, etc.), a 5- or 6-membered nitrogen-containing heterocyclic group (e.g., an imidazolyl group, a pyrazolyl group, a triazolyl group, a tetrazolyl group, a 1,2-dihydro-2-oxo-1-pyridyl group, etc.), an imido group (e.g., a succinimido group, a hydantoinyl group, etc.), an aromatic azo group (e.g., a phenylazo group, etc.), and the like. These groups may be substituted with the substituents acceptable for $R_1$. The releasable group bonded to the coupling carbon via a carbon atom includes a bis-type coupler obtainable by a condensation reaction of an aldehyde or ketone with a four-equivalent coupler. The releasable group according to the present invention may contain other photographically useful groups, such as a group capable of forming a development restrainer, a development accelerator, etc. Preferred combinations of releasable groups will be described hereinafter.

In the formula (I), $Y_1$ preferably represents a hydrogen atom and a halogen atom, and more preferably a chlorine atom.

In formula (II), the divalent linking group or atom preferably includes —NHCO—, —COO—, —$SO_2$NH—, —O—, —S—,

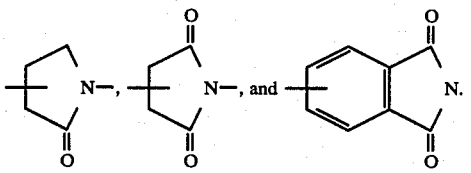

The first three of them may be attached to $R_5$ at either the right hand side or the left hand side thereof, while the last three groups are bonded to the phenyl group via a nitrogen atom thereof.

$R_4$ and $R_5$ may be substituted with substituents acceptable for $R_1$. When it is substituted with two or more substituents, these substituents may be the same or different.

$R_6$ preferably represents a hydrogen atom, an aliphatic acyl group, and an aliphatic sulfonyl group, with a hydrogen atom being particularly preferred.

$Y_2$ preferably represents a group releasable through a sulfur, oxygen, or nitrogen atom, and particularly preferably a sulfur atom.

It is well known in the art that the magenta couplers represented by the formula (II) include the following keto-enol tautomers when $R_6$ is a hydrogen atom. It is to be understood that the present invention includes in its scope the keto and enol tautomers.

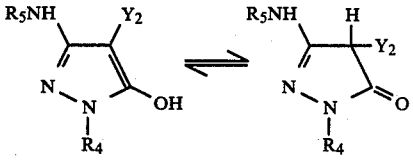

The compounds represented by formula (III) are 5-membered-5-membered-condensed nitrogen-containing heterocyclic couplers (hereinafter referred to as "5,5-heterocyclic couplers"). Their color forming nuclei have aromaticity isoelectronic to naphthalene and generally have a chemical structure called azapentalene. Among the couplers represented by formula (III), the preferred are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles and 1H-pyrazolo[1,5-d]tetrazoles, that are represented by formulae (V), (VI), (VII), (VIII), and (IX), respectively:

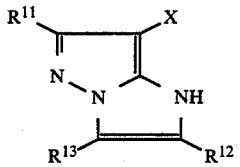

(V)

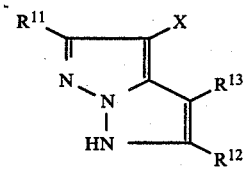

(VI)

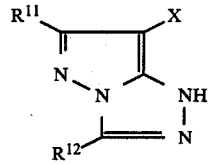

(VII)

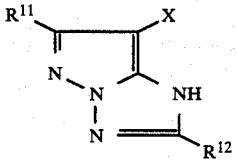

(VIII)

-continued

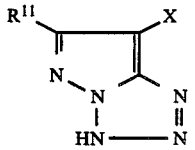

(IX)

In the above-described formulae (V) to (IX), $R^{11}$, $R^{12}$, and $R^{13}$ each represents a substituted or unsubstituted aliphatic group, a substituted or unsubstituted aromatic group, or a substituted or unsubstituted heterocyclic group, wherein the substituent is at least one of the substituents acceptable for $R_1$ (hereinafter collectively referred to by "R"). $R^{11}$, $R^{12}$, and $R^{13}$ each further represents RO—, $$\mathrm{RC(=O)-},\ \mathrm{RCO(=O)-},\ \mathrm{RSO-},\ \mathrm{RSO_2-},\ \mathrm{RSO_2NH-},\ \mathrm{RC(=O)NH-},$$

$$\mathrm{RNH-},\ \mathrm{RS-},\ \mathrm{ROC(=O)NH-},$$

a hydrogen atom, a halogen atom, a cyano group, or an imido group. $R^{11}$, $R^{12}$, and $R^{13}$ each furthermore represents a carbamoyl group, a sulfamoyl group, an ureido group, or a sulfamoylamino group, a nitrogen atom of which may be substituted with the substituent acceptable for $R_1$. X has the same meaning as $Y_3$. Also, any one of $R^{11}$, $R^{12}$, $R^{13}$, and X may be a divalent group forming dimer, or may be a divalent group which links a high polymeric main chain and a coupling group.

Preferred examples of $R^{11}$, $R^{12}$, and $R^{13}$ are a hydrogen atom, a halogen atom, the substituents specified by R, RO—, RCONH—, $RSO_2NH$—, RNH—, RS—, and ROCONH. Preferred examples of X are a halogen atom, an acylamino group, an imido group, an aliphatic or aromatic sulfonamido group, a 5- or 6-membered nitrogen-containing heterocyclic group which is bonded to a coupling active position via a nitrogen atom thereof, an aryloxy group, and an alkoxy group.

In formula (IV), the substituted N-phenylcarbamoyl group as represented by $R_8$ is substituted with at least one substituent which can arbitrarily selected from those acceptable for $R_1$. Two or more substituents thereof may be the same or different.

$R_8$ preferably includes a group represented by the formula (IVA):

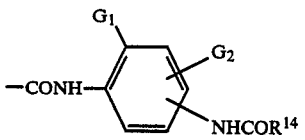

(IVA)

wherein $G_1$ represents a halogen atom or an alkoxy group; $G_2$ represents a hydrogen atom, a halogen atom, or a substituted or unsubstituted alkoxy group; and $R^{14}$ represents a substituted or unsubstituted alkyl group.

Typical examples of the substituent for $G_2$ or $R^{14}$ in the formula (IVA) includes an alkyl group, an alkoxy group, an aryl group, an aryloxy group, an amino group, a dialkylamino group, a heterocyclic group (e.g., an N-morpholino group, an N-piperidino group, a 2-furyl group, etc.), a halogen atom, a nitro group, a hydroxyl group, a carboxyl group, a sulfo group, an alkoxycarbonyl group, etc.

The releasable group $R_4$ preferably includes groups represented by formulae (X) to (XVI):

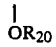

(X)

wherein $R_{20}$ represents a substituted or unsubstituted aryl group or a substituted or unsubstituted heterocyclic group.

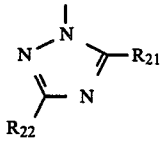

(XI)

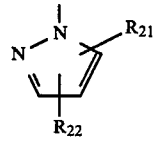

(XII)

wherein $R_{21}$ and $R_{22}$ (which may be the same or different) each represents a hydrogen atom, a halogen atom, a carboxylic ester group, an amino group, an alkyl group, an alkylthio group, an alkoxy group, an alkylsulfonyl group, an alkylsulfinyl group, a carboxyl group, a sulfo group, a substituted or unsubstituted phenyl group or a substituted or unsubstituted heterocyclic group.

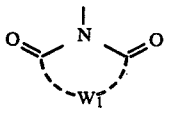

(XIII)

wherein $W_1$ represents a non-metallic atom group necessary to form a 4-, 5-, or 6-membered ring together with

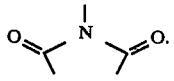

Among the groups of formula (XIII), those preferred are represented by the formulae (XIV) to (XVI):

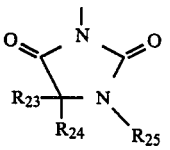

(XIV)

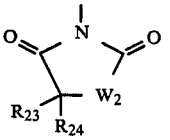

(XV)

-continued (XVI)

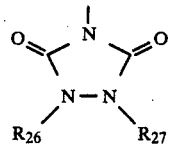

wherein $R_{23}$ and $R_{24}$ each represents a hydrogen atom, an alkyl group, an aryl group, an alkoxy group, an aryloxy group, or a hydroxyl group; $R_{25}$, $R_{26}$, and $R_{27}$ each represents a hydrogen atom, an alkyl group, an aryl group, an aralkyl group or an acyl group; and $W_2$ represents an oxygen atom or a sulfur atom.

Illustrative examples of the couplers having the formulae (I) to (IX) and the processes for synthesizing them are described, e.g., in Japanese Patent Publication No. 11572/74 and U.S. Pat. No. 3,779,763 for the compounds of the formula (I); in Japanese Patent Application (OPI) Nos. 111631/74 and 126833/81 and U.S. Pat. No. 4,351,897 for the compounds of the formula (II); in Japanese Patent Application (OPI) No. 48541/79, Japanese Patent Publication No. 10739/83, U.S. Pat. No. 4,326,024, and *Research Disclosure,* RD No. 18053, for the compounds of the formula (IV); Japanese Patent Application No. 23434/83 for the compounds of the formula (V); Japanese Patent Application No. 151354/83 for the compounds of the formula (VI); Japanese Patent Publication No. 27411/72 for the compounds of formula (VII); Japanese Patent Application Nos. 45512/83 and 27745/84 for the compounds of the formula (VIII); and Japanese Patent Application No. 142801/83 for the compounds of the formula (IX). Ballast groups having high color forming property as disclosed in Japanese Patent Application (OPI) No. 42045/83, Japanese Patent Application Nos. 88940/83, 52923/83, 52924/83 and 52927/83, etc., can be linked to any of the compounds of formulae (I) through (IX).

The 5,5-N-heterocyclic couplers having the formula (III) can form a magenta color with less unnecessary side absorption of yellow upon coupling with an oxidation product of a color developing agent thereby providing a color print superior in color separation and color reproduction as compared with the 5-pyrazolone couplers represented by formula (II). In other words, it has been demanded to realize a magenta dye which is not only free from side absorption in the yellow region of the spectrum, but also whose absorption decreases sharply to zero on the longer wavelength side, and the compounds of formula (III) are couplers capable of forming such a dye.

Among the 5,5-N-heterocyclic couplers represented by the aforesaid formulae (V) to (IX), couplers which develop a color having the particularly preferred hue as mentioned above belong to the formulae (V), (VII), and (VIII). Further, the couplers belonging to the formulae (V), (VI), (VIII), and (IX) produce a magenta dye having higher light-fastness than that produced by the couplers of formula (VII). 1H-Pyrazolo[1,5-b][1,2,4]triazole couplers belonging to formula (VIII) are most excellent from synthetic considerations and in view of their absorption spectra, light- and heat-fastness, and discoloration balance of the developed magenta dye.

Specific examples of the compounds represented by formulae (I), (II) or (III), and (IV) are given below, with C-representing cyan-dye-forming couplers, M-representing magenta-dye-forming couplers, and Y-representing yellow-dye-forming couplers, respectively. The present invention is not, however, limited to these illustrative compounds.

(C-1)

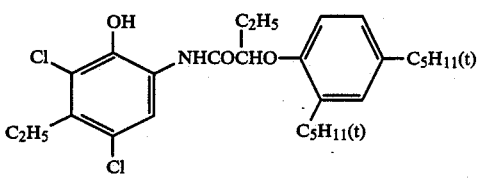

(C-2)

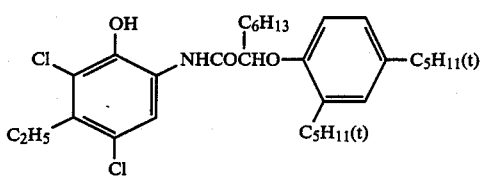

(C-3)

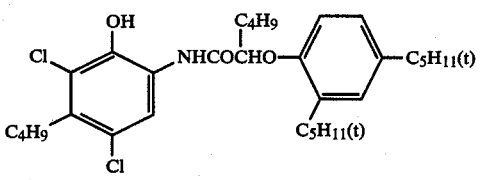

(C-4)

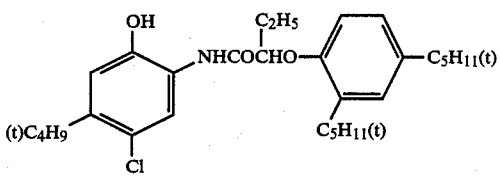

(C-5)

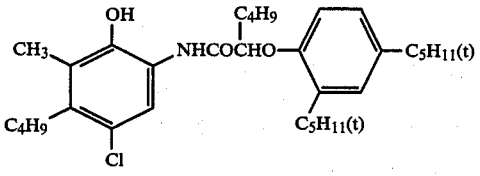

(C-6)

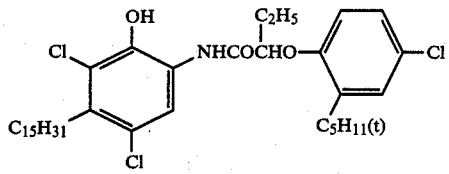

(C-7)

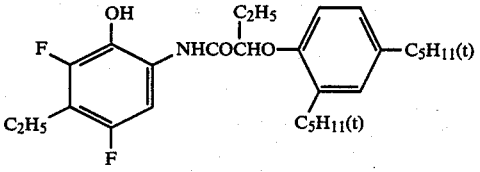

(C-8)

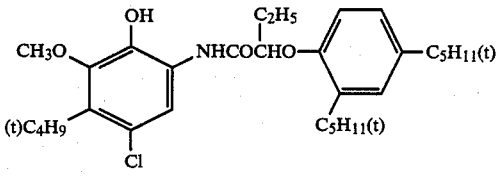

-continued
(C-10)
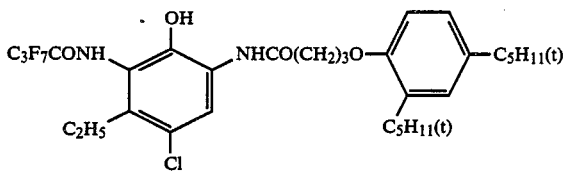
(C-11)
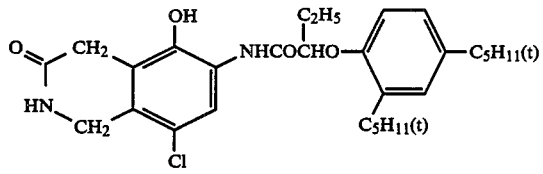
(C-12)
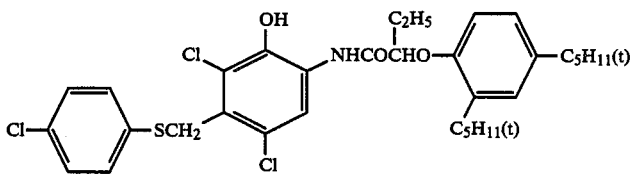
(C-13)
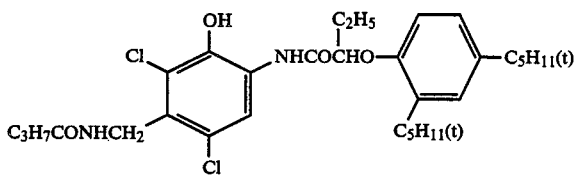
(C-14)
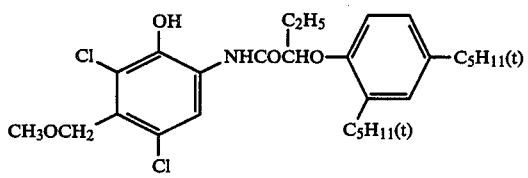
(C-15)
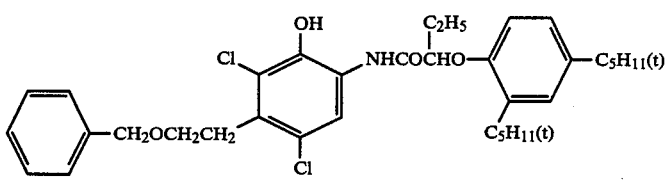
(C-16)
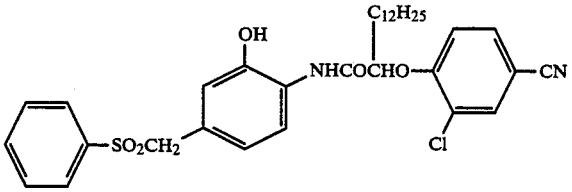
(C-17)
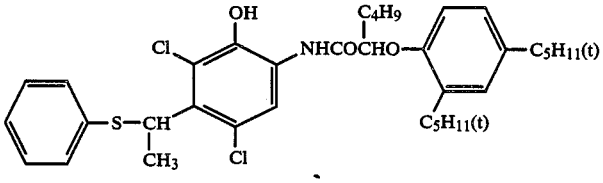

-continued
(C-18)
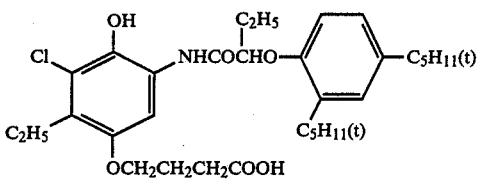
(C-19)
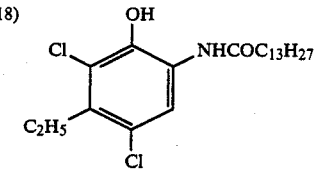
(C-20)
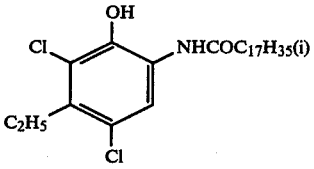
(C-21)
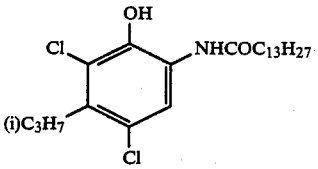
(C-22)
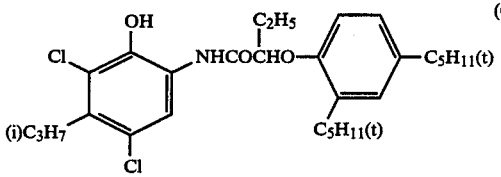
(C-23)
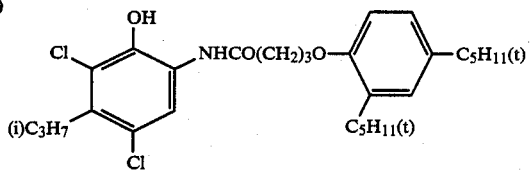
(C-24)
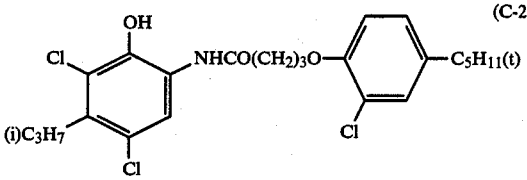
(C-25)
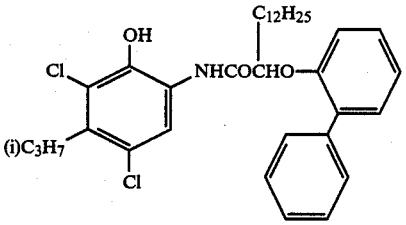
(C-26)
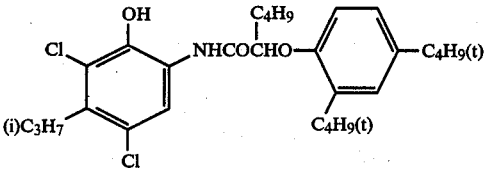
(C-27)
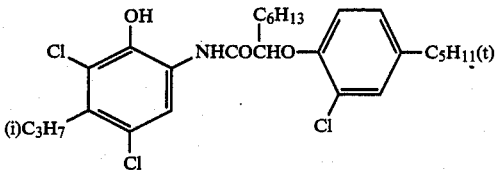
(C-28)
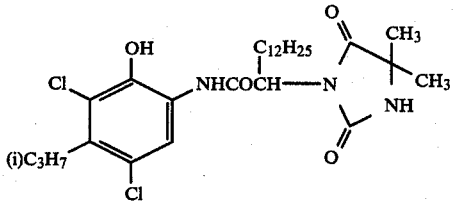
(C-29)
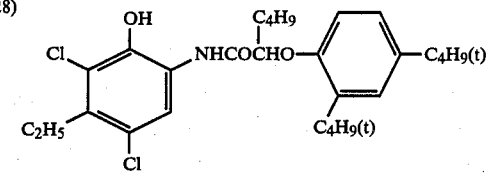
(C-30)
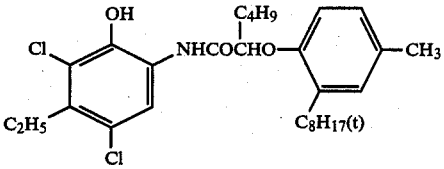
(C-31)
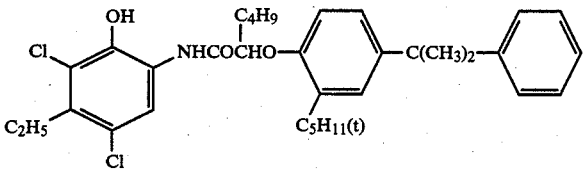

-continued
(C-32)
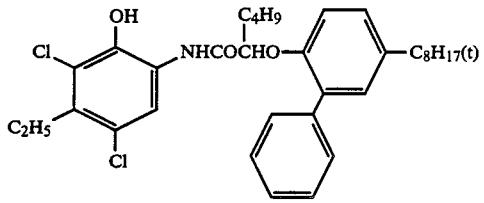
(C-33)
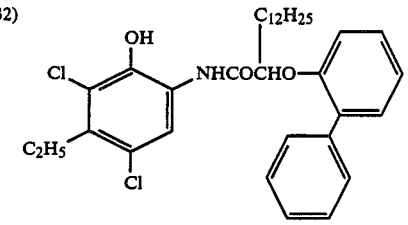
(C-34)
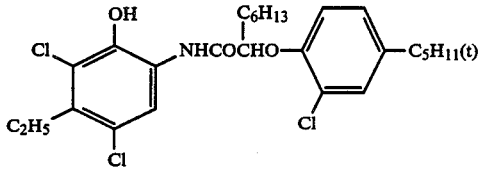
(C-35)
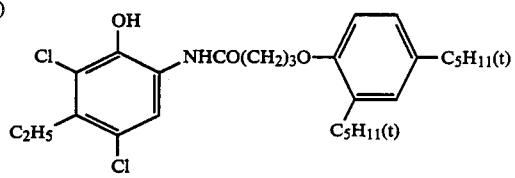
(C-36)
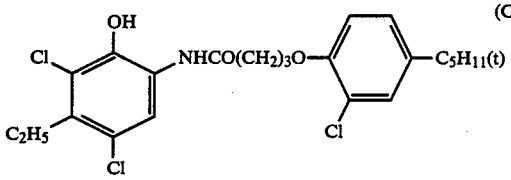
(C-37)
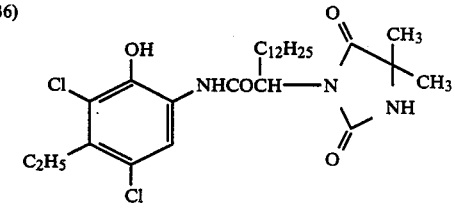
(C-38)
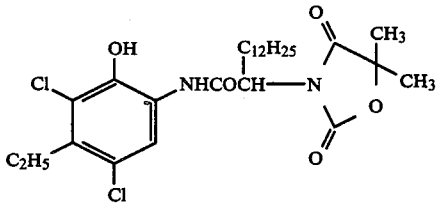
(M-1)
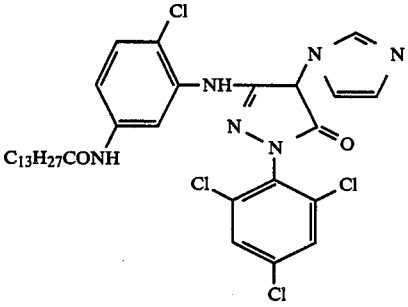
(M-2)
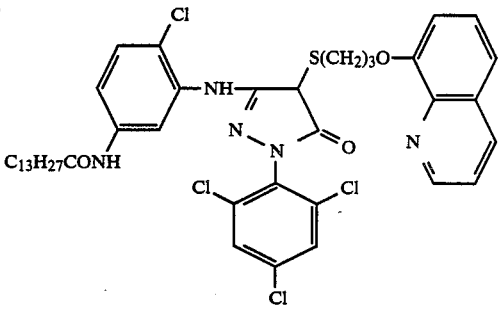
(M-3)
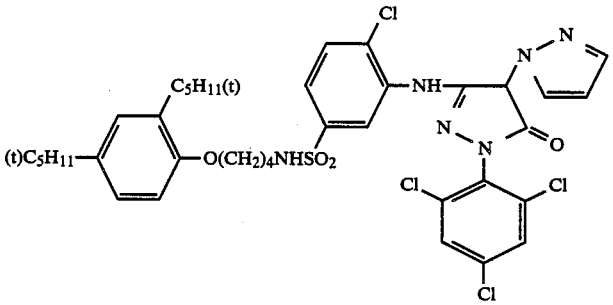

-continued
(M-4)
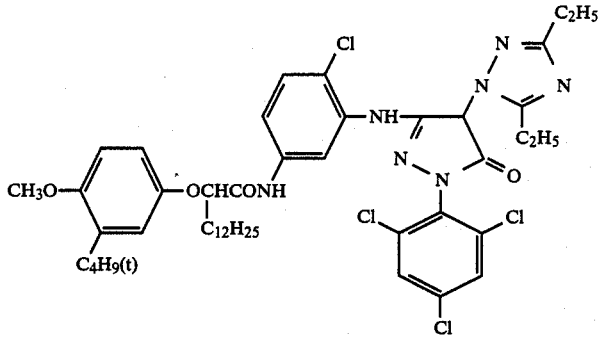
(M-5)
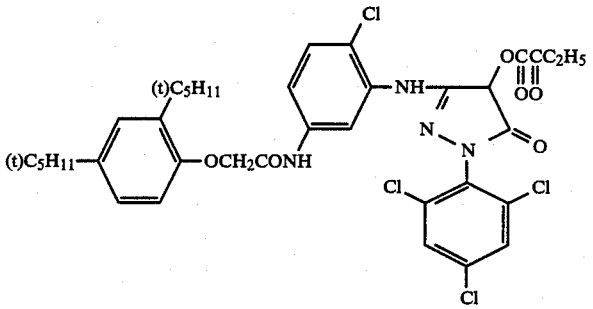
(M-6)
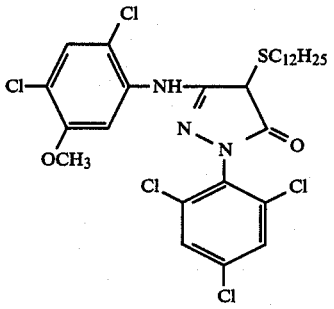
(M-7)
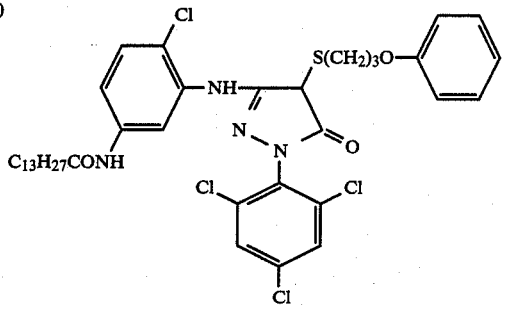
(M-8)
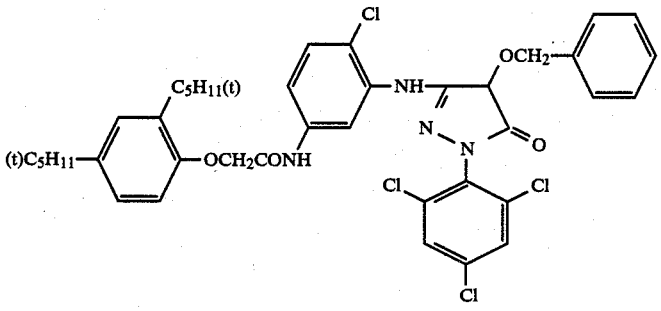
(M-9)
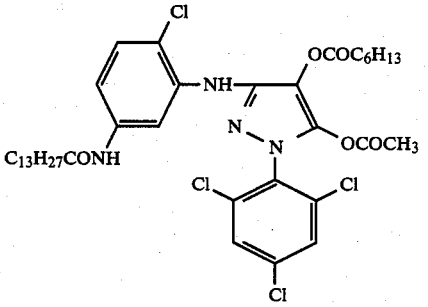

-continued
(M-10)
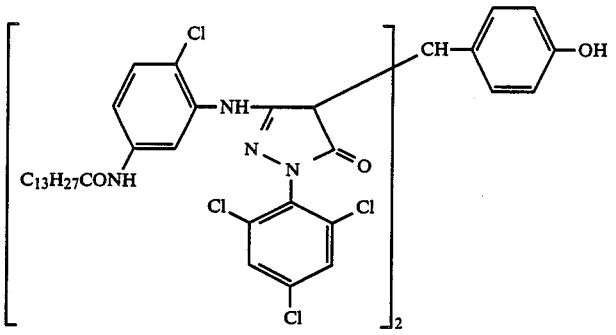
(M-11)
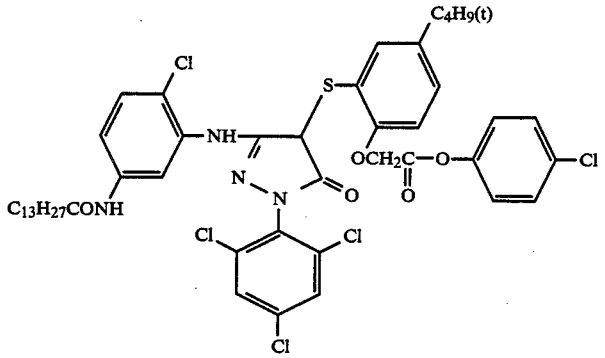
(M-12)
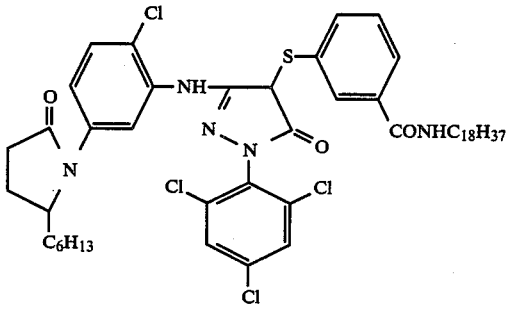
(M-13)
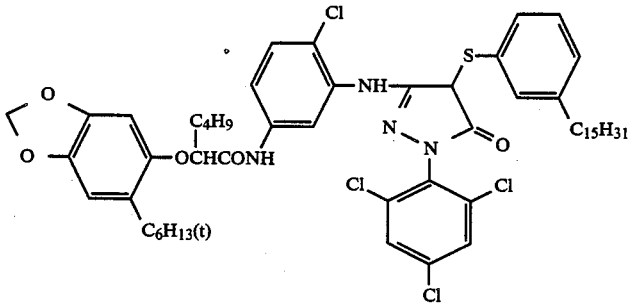
(M-14)
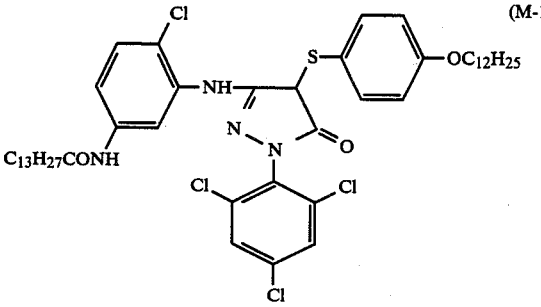
(M-15)
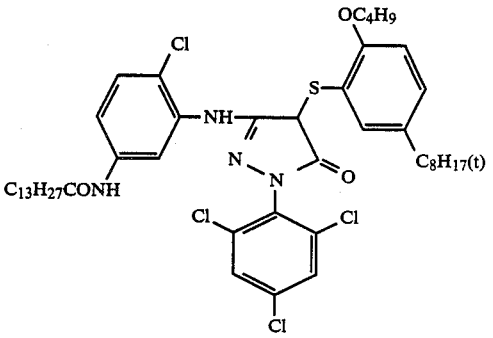

-continued
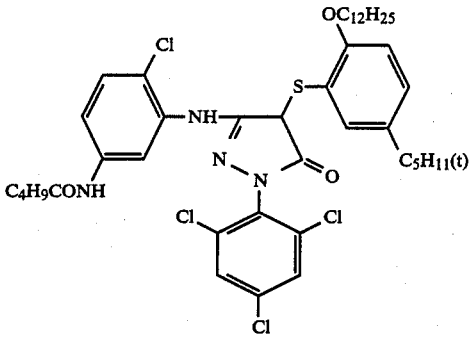
(M-16)
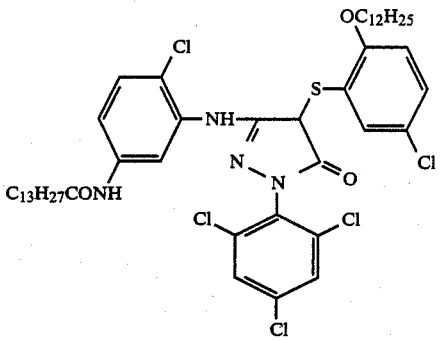
(M-17)
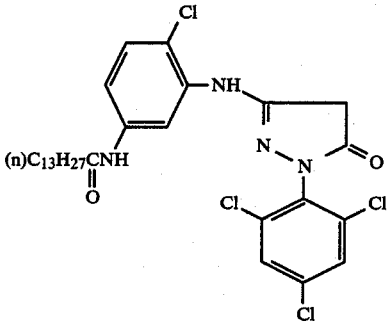
(M-18)
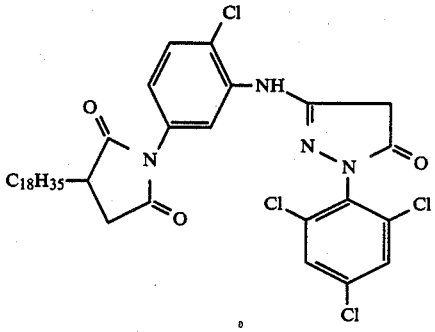
(M-19)
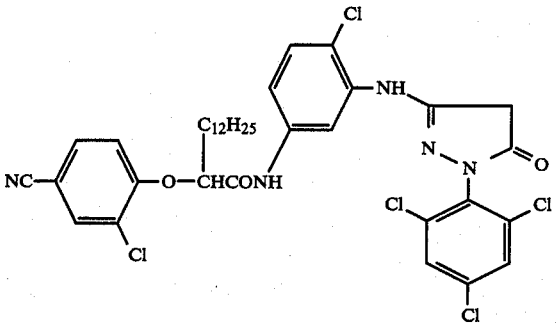
(M-20)
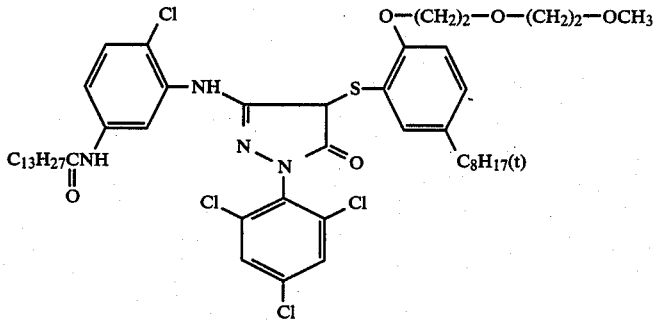
(M-21)
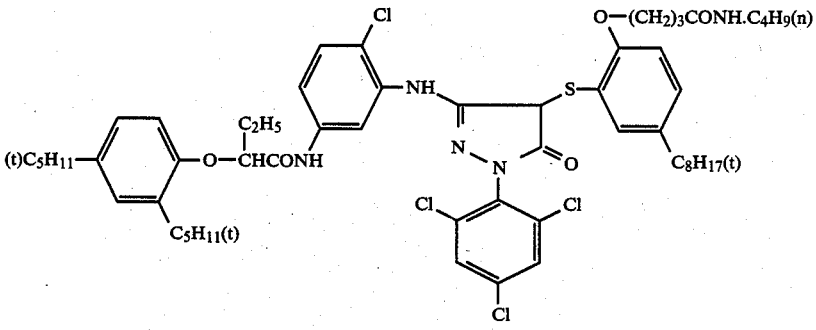
(M-22)

-continued
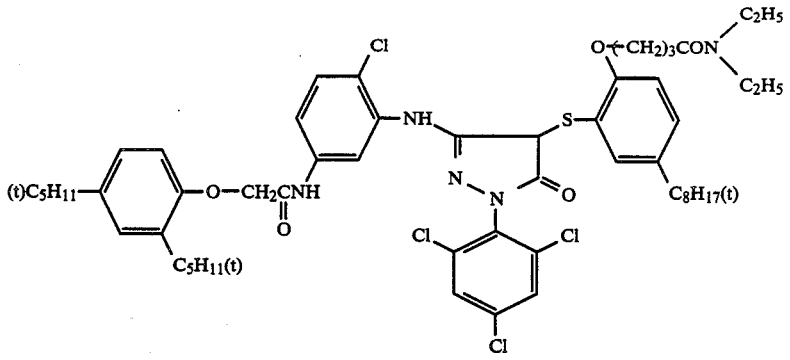
(M-23)
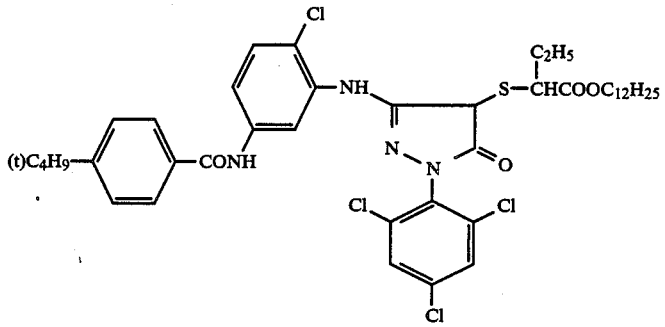
(M-24)
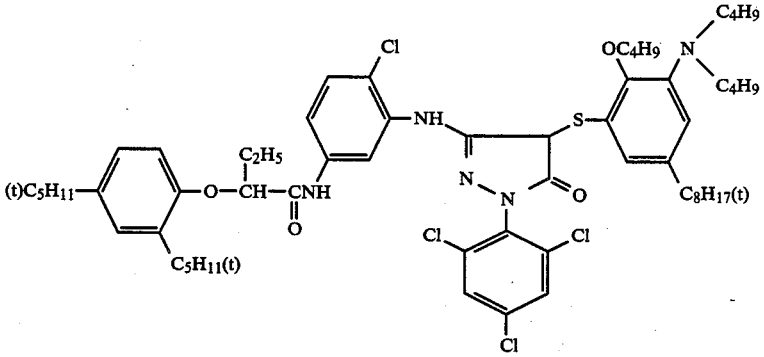
(M-25)
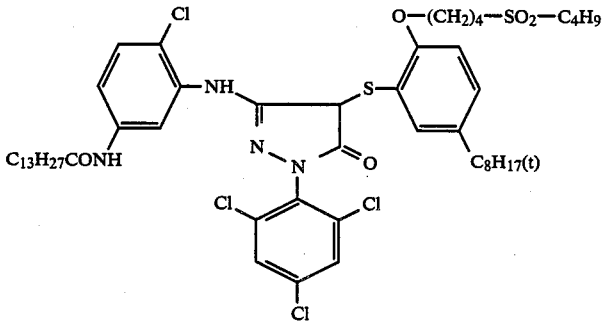
(M-26)

-continued
(M-27)
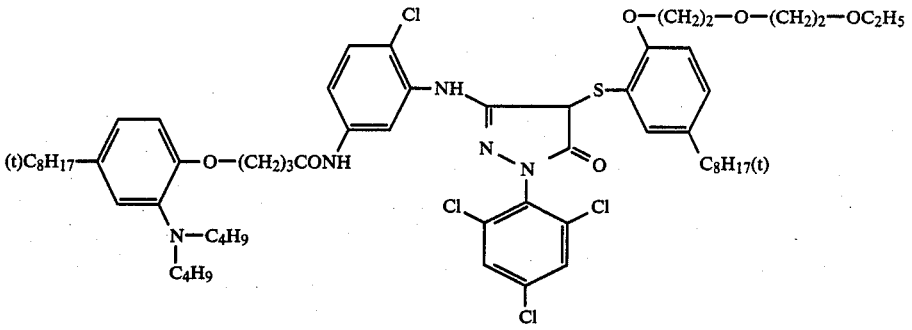
(M-28)
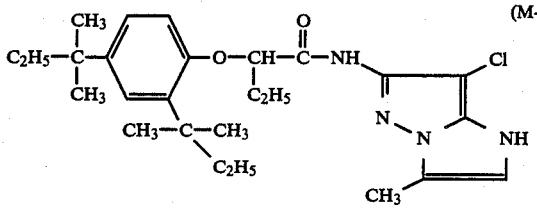
(M-29)
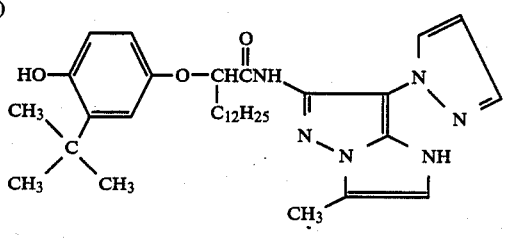
(M-30)
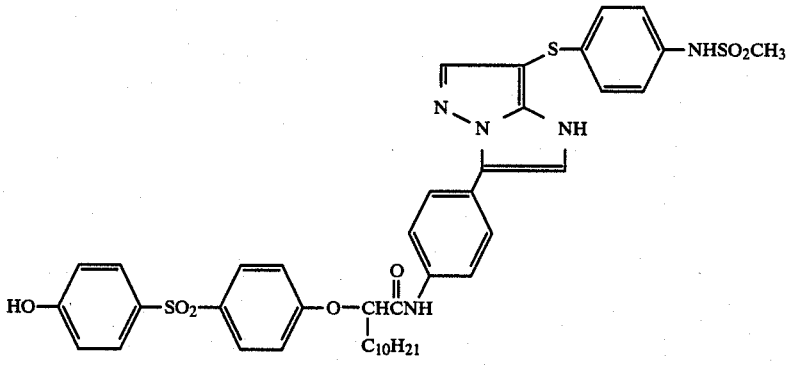
(M-31)
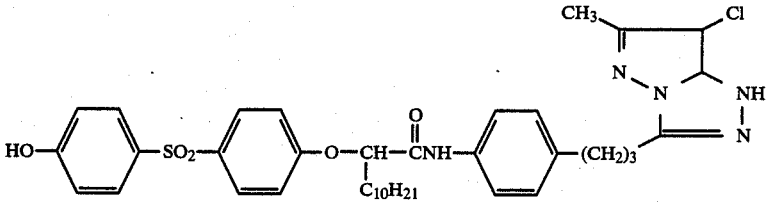
(M-32)
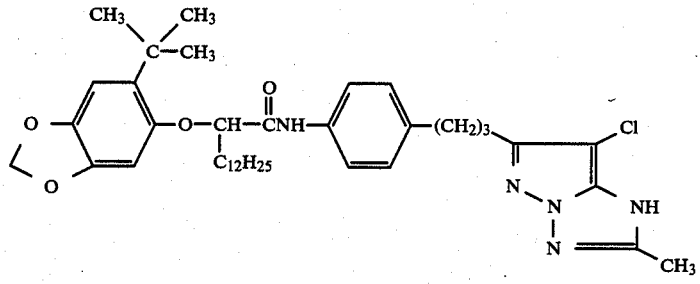
(M-33)
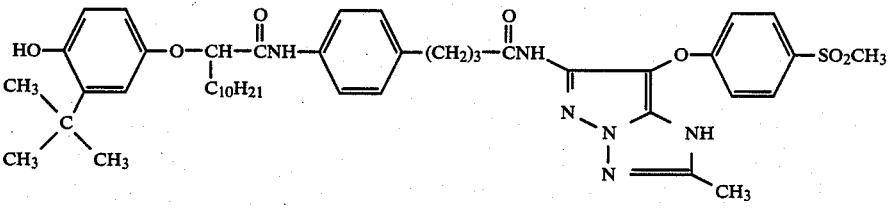

-continued
(M-34)
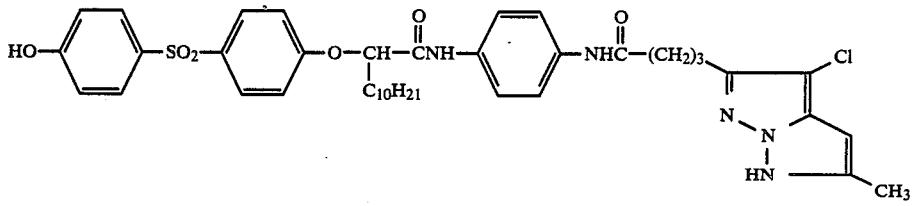
(M-35)
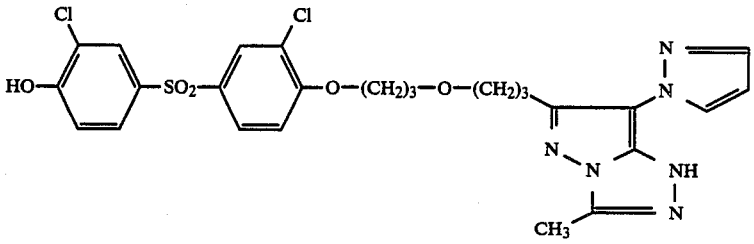
(M-36)
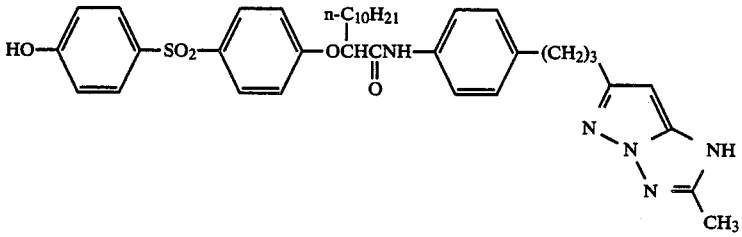
(M-37)
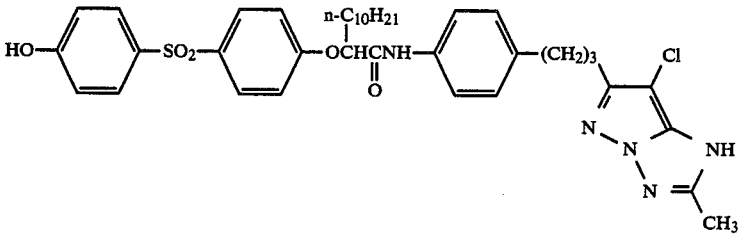
(M-38)
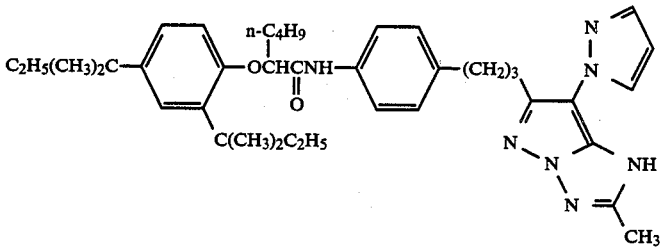
(M-39)
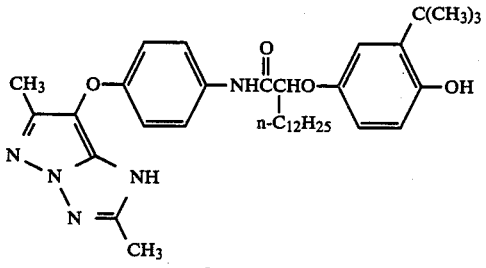

-continued
(M-40)
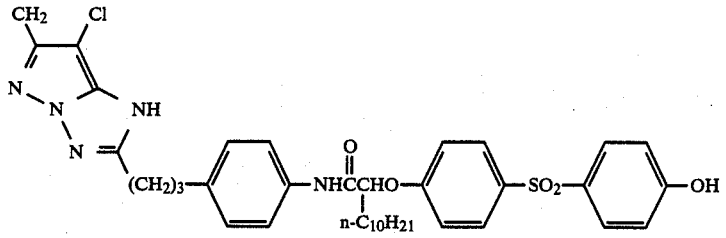
(M-41)
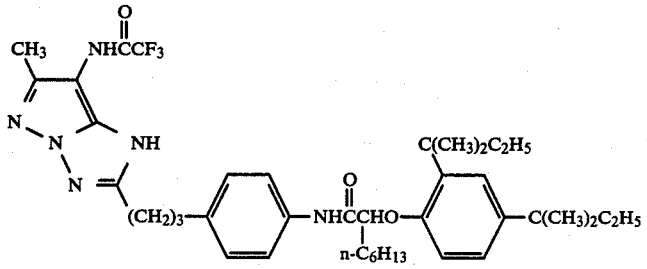
(M-42)
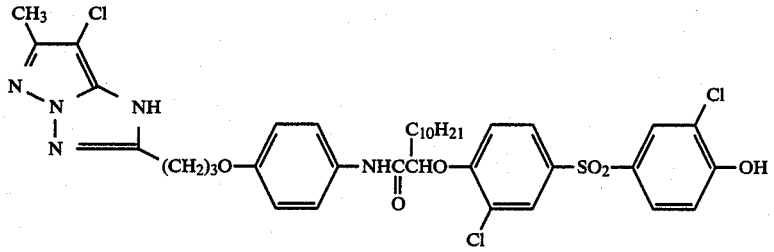
(M-43)
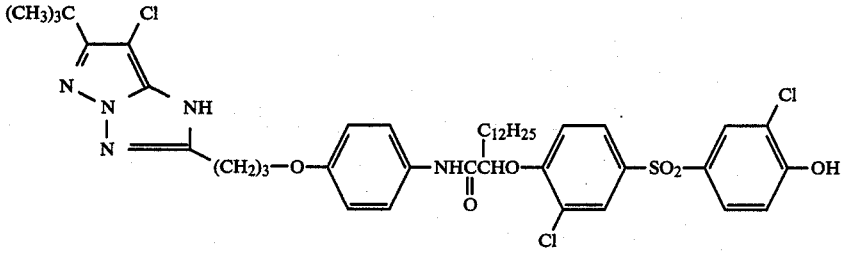
(M-44)
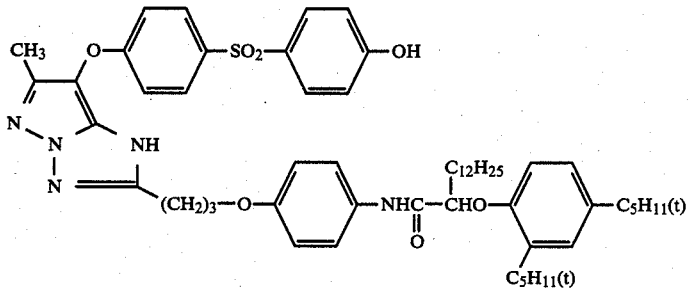
(M-45)
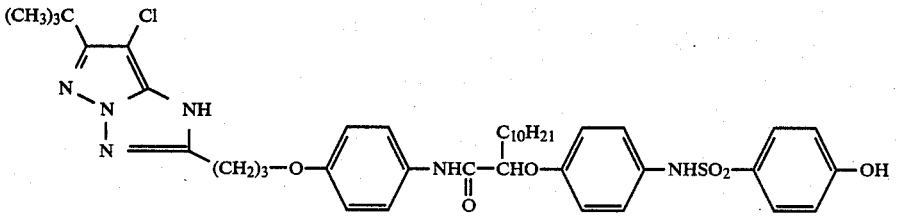

-continued
(M-46)
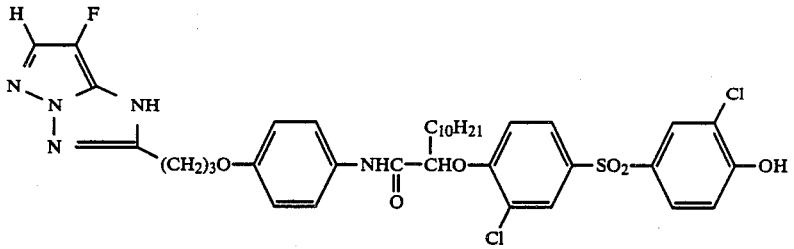
(M-47)
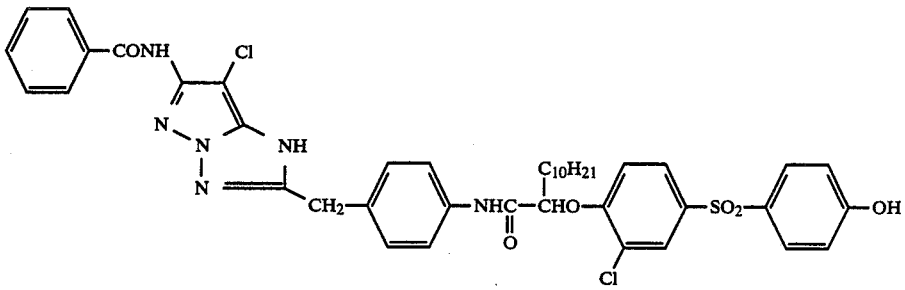
(M-48)
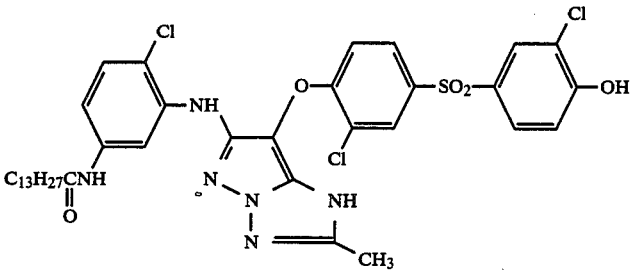
(M-49)
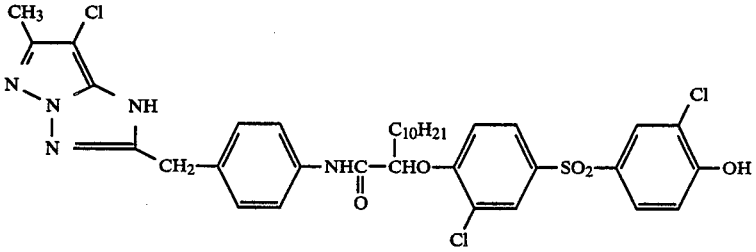
(M-50)
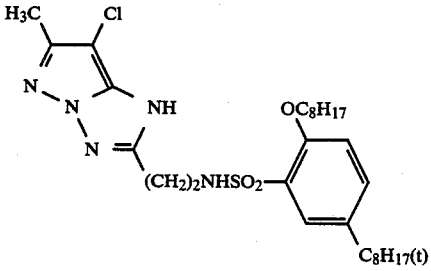
(M-51)
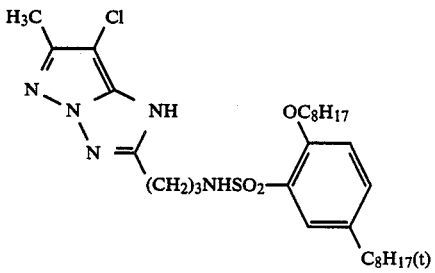
(M-52)
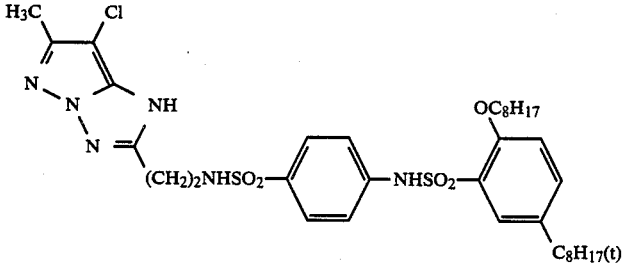

-continued
(M-53)
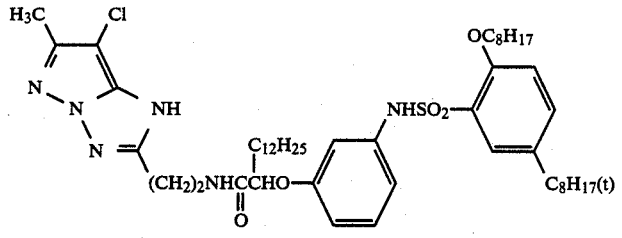
(M-54)
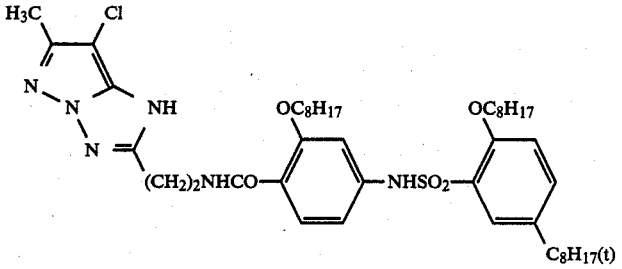
(Y-1)
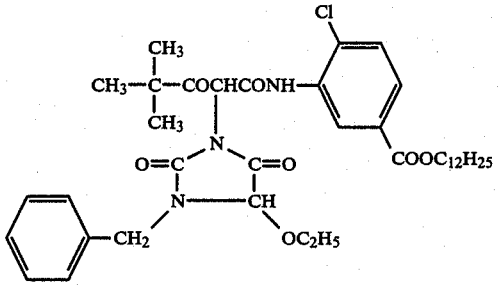
(Y-2)
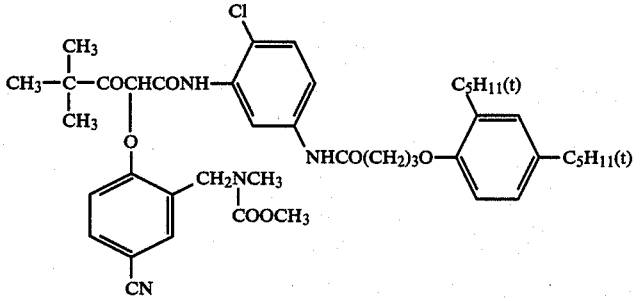
(Y-3)
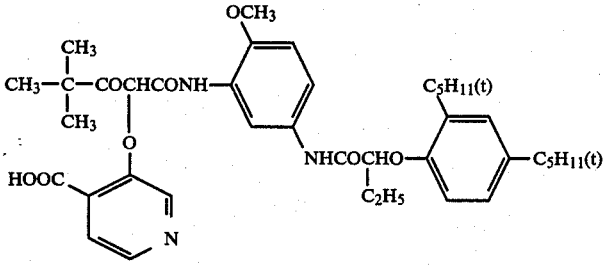

-continued
(Y-4)
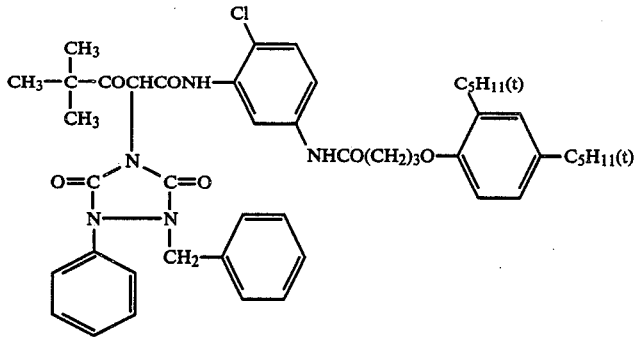
(Y-5)
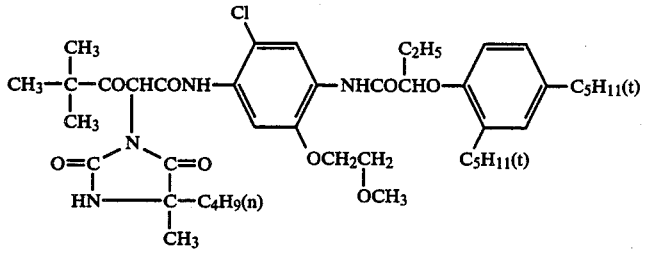
(Y-6)
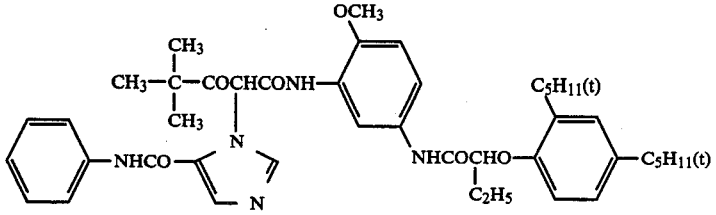
(Y-7)
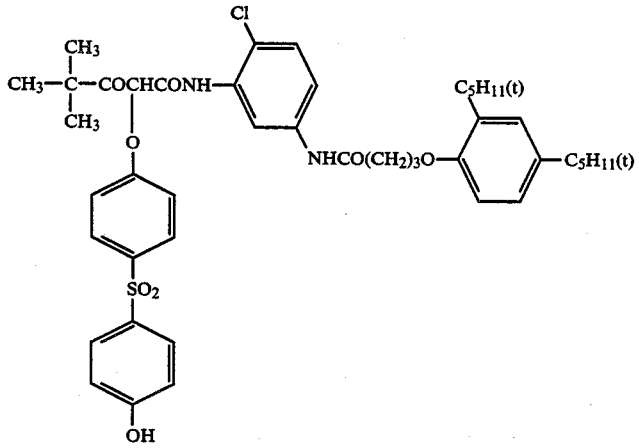

-continued
(Y-8)
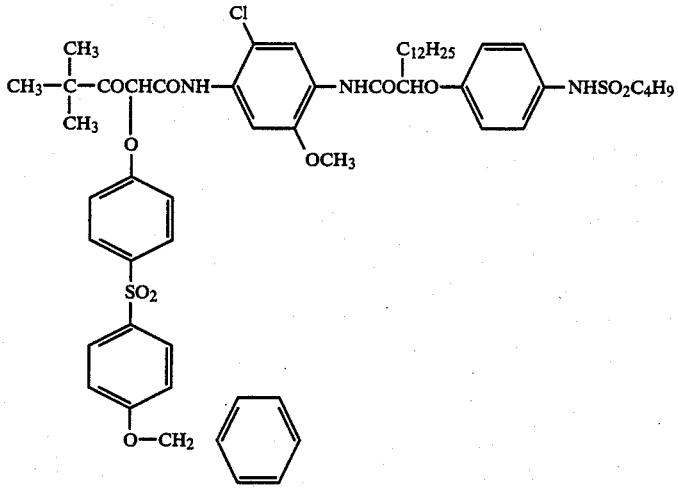
(Y-9)
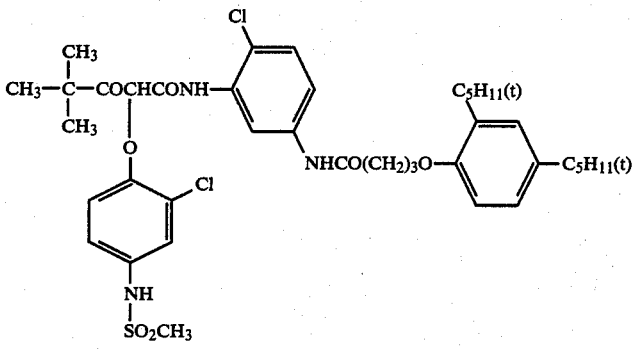
(Y-10)
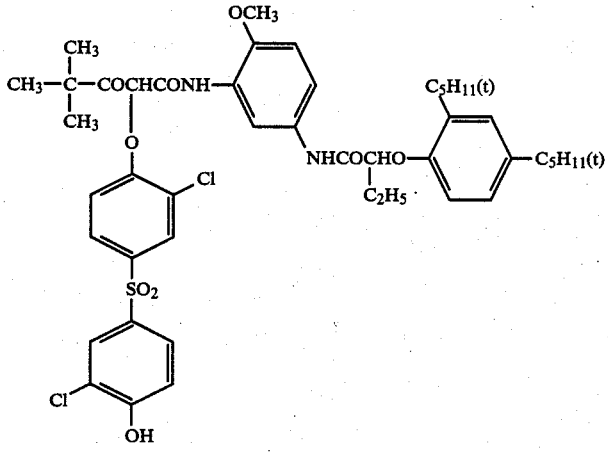

-continued
(Y-11)
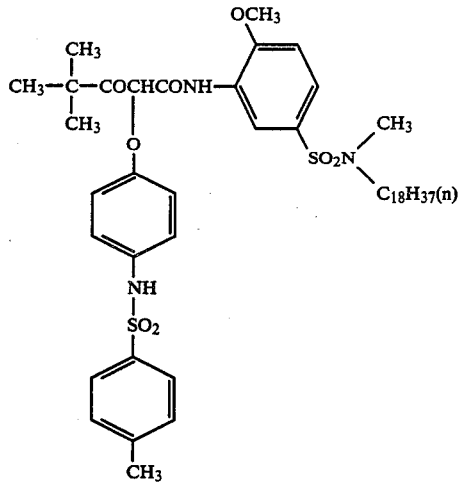
(Y-12)
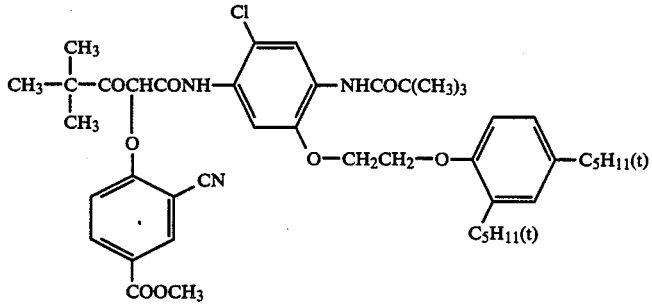
(Y-13)
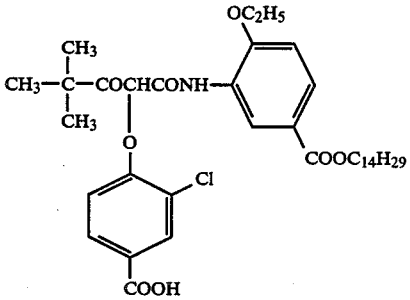
(Y-14)
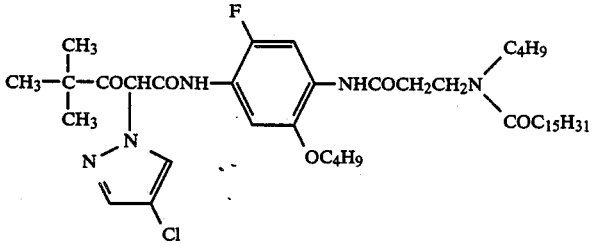
(Y-15)
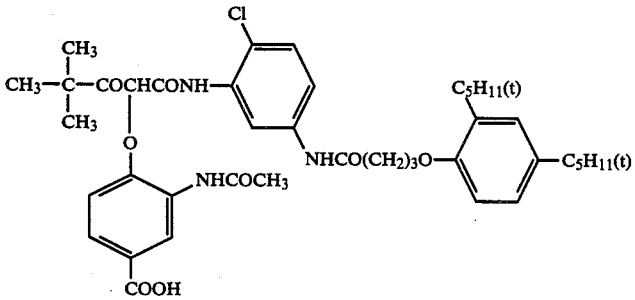

-continued
(Y-16)
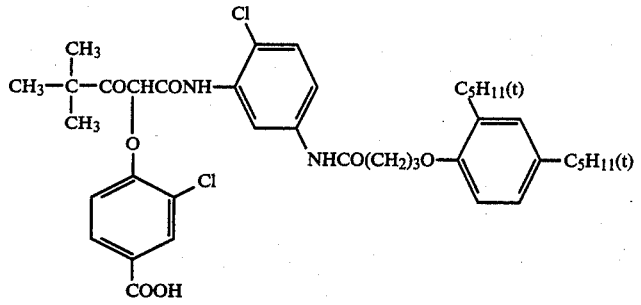
(Y-17)
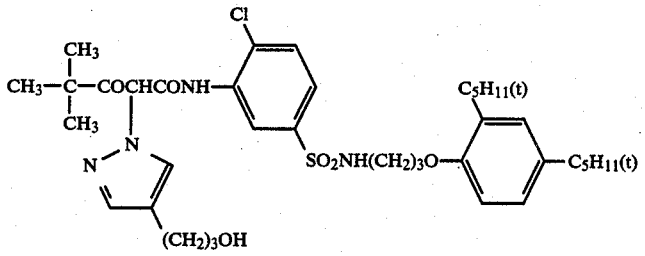
(Y-18)
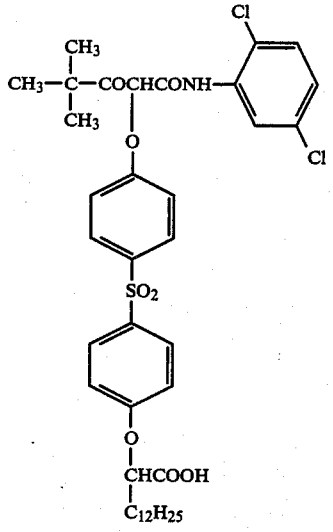
(Y-19)
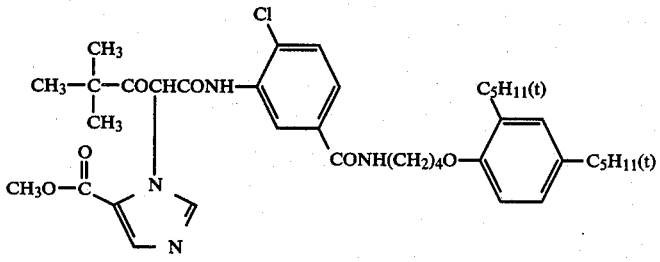
(Y-20)
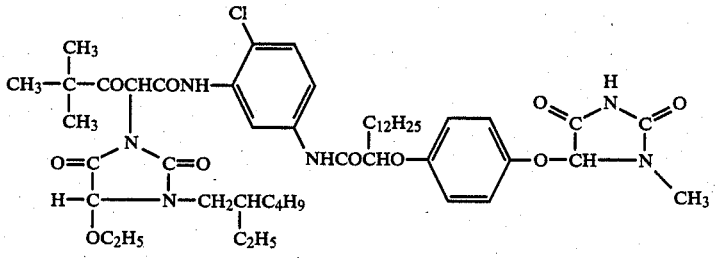

-continued
(Y-21)
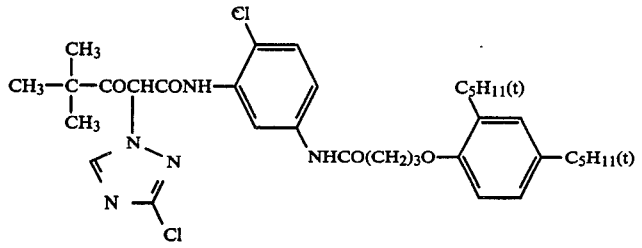
(Y-22)
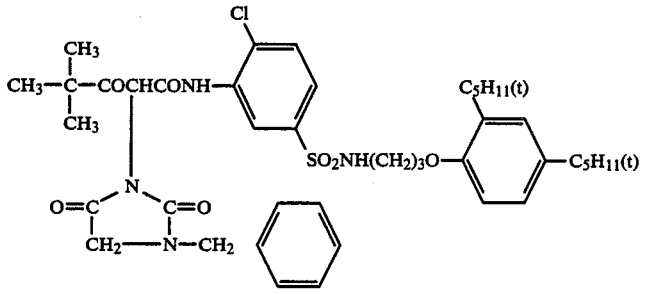
(Y-23)
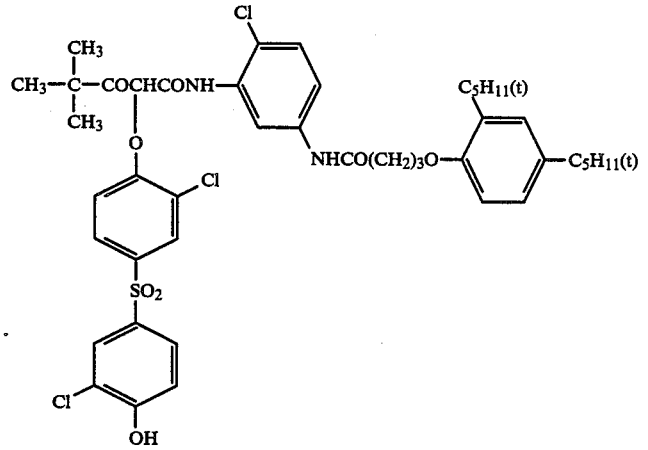
(Y-24)
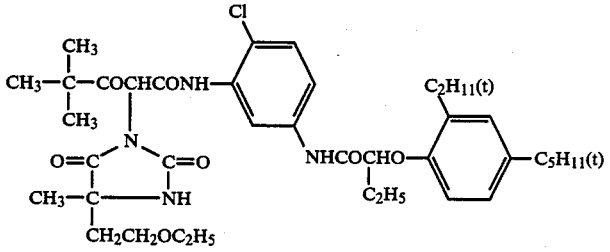
(Y-25)
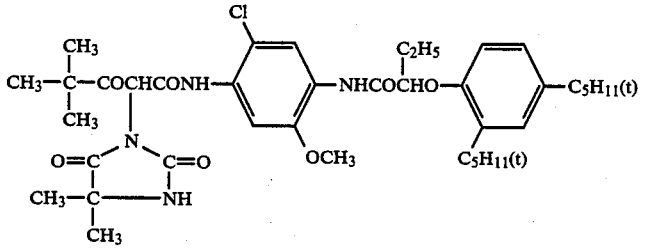

-continued
(Y-26)
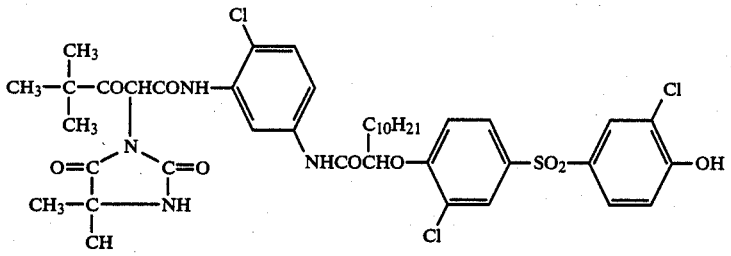
(Y-27)
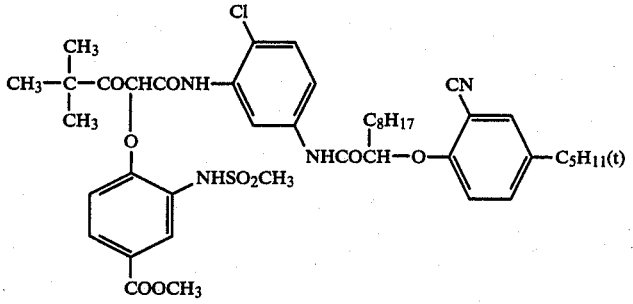
(Y-28)
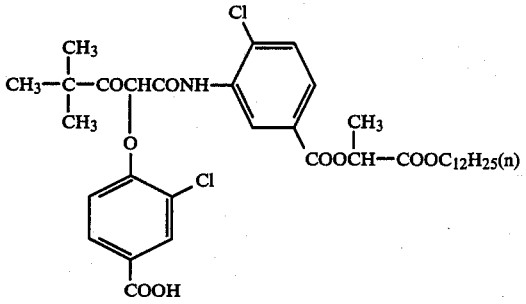
(Y-29)
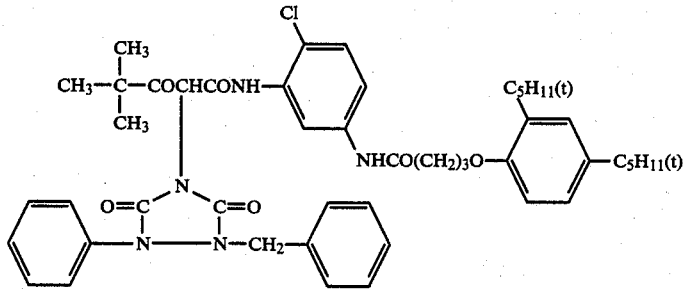
(Y-30)
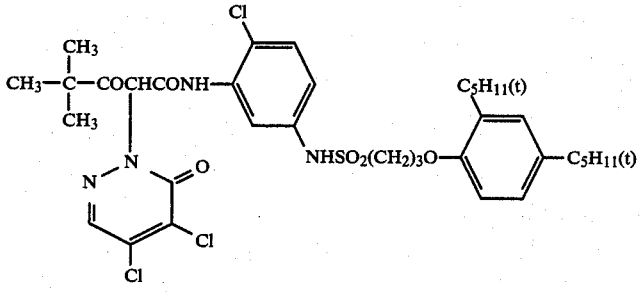

-continued
(Y-31)
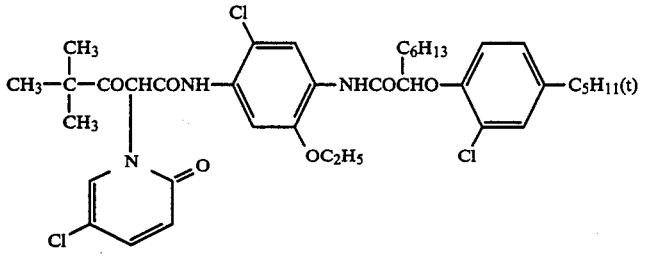
(Y-32)
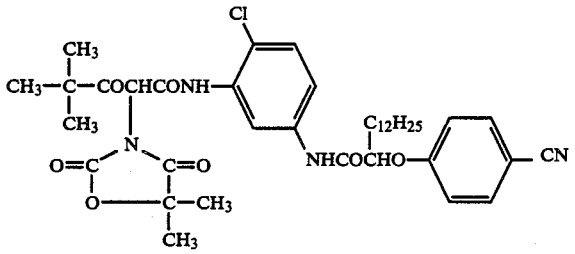
(Y-33)
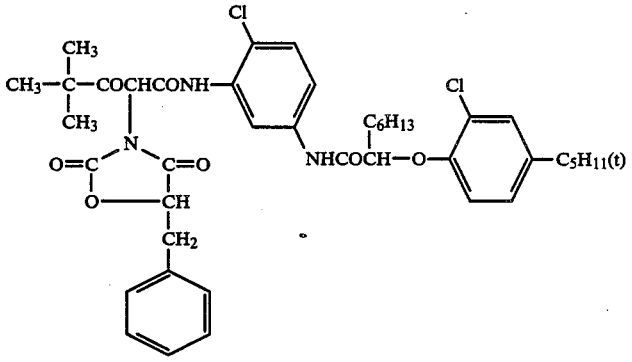
(Y-34)
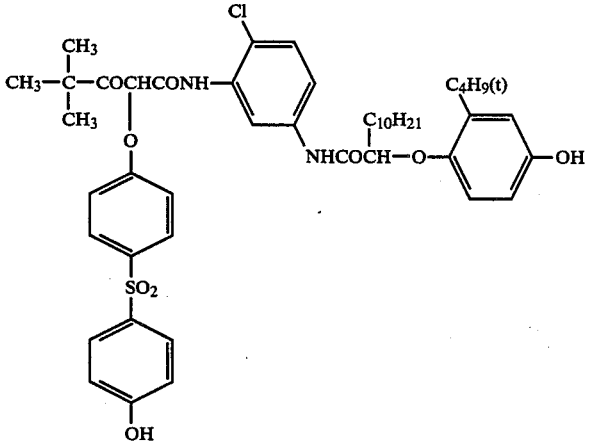
(Y-35)
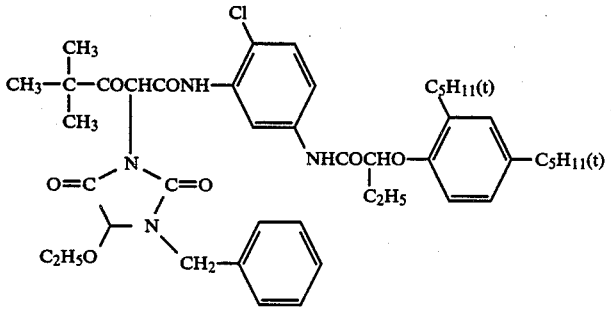

-continued
(Y-36)
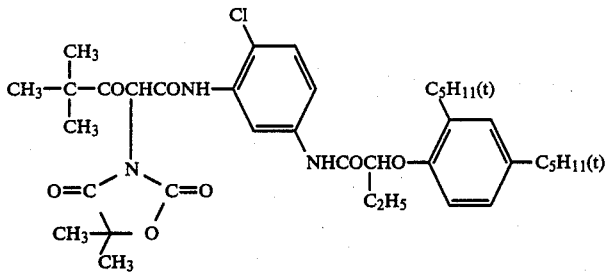
(Y-37)
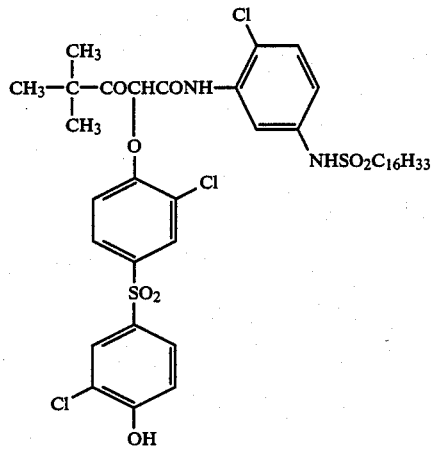
(Y-38)
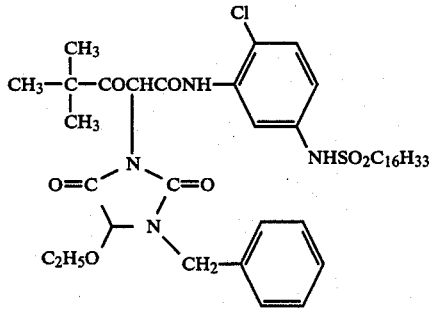
(Y-39)
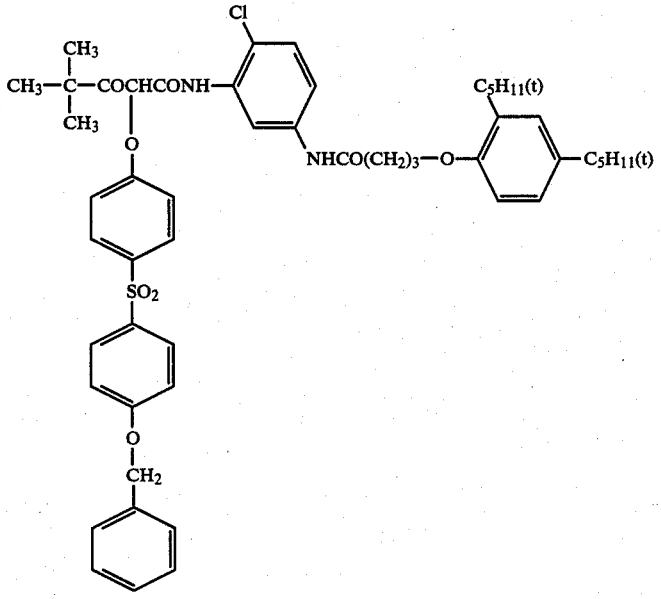

-continued (Y-40)

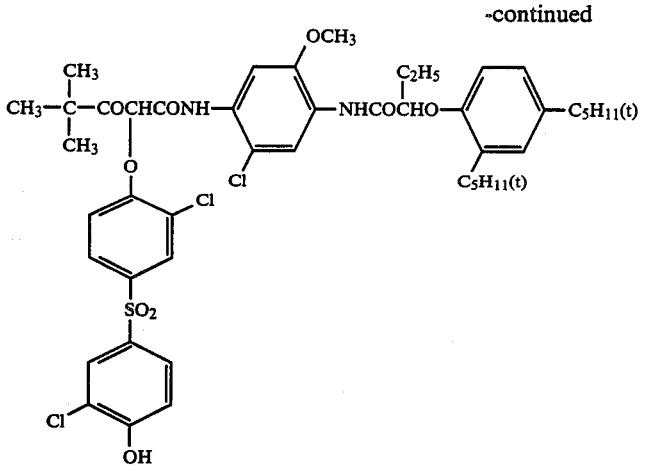

(Y-41)

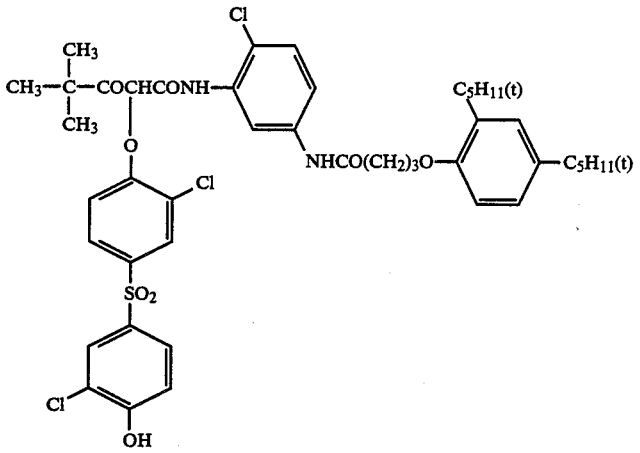

The coupler represented by the formula (I), (II) or (III), or (IV) is incorporated in a silver halide emulsion layer constituting a light-sensitive layer in an amount of from 0.1 to 1.0 mol, and preferably from 0.1 to 0.5 mol, per mol of the silver halide on an individual basis. A molar ratio of each of the couplers (I), (II) or (III), and (IV) preferably ranges from about 1/0.2/0.5 to about 1/1.5/1.5, but molar ratios out of the above range may also be applicable.

Incorporation of the couplers according to the present invention can be carried out by various known techniques. It is generally effected by oil-in-water dispersion known as an oil protection process. For example, the coupler is dissolved in a high-boiling organic solvent, such as a phthalic ester, e.g., dibutyl phthalate, dioctyl phthalate, etc., and a phosphoric ester, e.g., tricresyl phosphate, trinonyl phosphate, etc., or a low-boiling organic solvent, such as ethyl acetate, alone or a mixed solvent thereof, and the solution is emulsified and dispersed in an aqueous solution of gelatin containing a surface active agent. An oil-in-water dispersion can also be obtained through phase inversion by adding water or a gelatin aqueous solution of a coupler solution containing a surface active agent. Further, an alkali-soluble coupler can be dispersed by the so-called Fischer's dispersion method. After the low-boiling organic solvent is removed from the resulting coupler dispersion by distillation, the noodle washing method, ultrafiltration or the like, the residue may be mixed with a photographic emulsion.

Solvents which can be used, if desired, in the introduction of the yellow coupler, magenta coupler and cyan coupler according to the present invention in an emulsion layer include high-boiling organic solvents having a boiling point of 160° C. or more, such as alkyl phthalates (e.g., dibutyl phthalate, dioctyl phthalate, etc.), phosphoric esters (e.g., diphenyl phosphate, triphenyl phosphate, tricresyl phosphate, dioctylbutyl phosphate, etc.), citric esters (e.g., tributyl acetylcitrate), benzoic esters (e.g., octyl benzoate), alkylamides (e.g., diethyllaurylamide), fatty acids esters (e.g., dibutoxyethyl succinate, dioctyl azelate), phenols (e.g., 2,4-di-t-amylphenol), and the like; and low-boiling organic solvents having a boiling point of from 30° to 150° C., such as lower alkyl acetates (e.g., ethyl acetate, butyl acetate, etc.), ethyl propionate, secbutyl alcohol, methyl isobutyl ketone, β-ethoxyethyl acetate, methyl cellosolve acetate, and the like; these may be used singly or in combinations thereof. Of these solvents, alkyl phthalates and phosphoric ester are preferred in the present invention.

Two or more couplers selected from each coupler group forming the same hue as represented by the formula (I), (II) or (III), or (IV) can be used in combination. Such being the case, the two or more couplers may be either co-emulsified or individually emulsified followed by mixing. These couplers may be used as a mixture with the hereinafter described discoloration inhibitor.

The coupler of the formula (I) may be mixed with other known cyan couplers, but the effects of the present invention can be noticeably exerted with the mixing molar ratio of the cyan coupler according to this invention is at least 30 mol%, and preferably at least 50 mol%. Cyan couplers acceptable for mixing include those described, e.g., in Japanese Patent Application (OPI) Nos. 80045/81, 166956/84 and 195642/84.

In order to achieve the objects of this invention, it is preferable to adjust the weight ratio of the high-boiling organic solvent to the yellow coupler used according to the present invention to not more than 1.0, and more preferably from 0.1 to 0.8. The most suitable amount of the high-boiling solvent used for dissolving the magenta coupler or cyan coupler should be determined taking into consideration the solubility of the coupler or developability of the light-sensitive material. It is usually selected from 10 to 300% based on the weight of the magenta coupler or cyan coupler of the present invention.

The light-sensitive materials according to the present invention can contain, if desired, special couplers other than the couplers represented by the above-described formulae. For example, a green-sensitive emulsion layer can contain a colored magenta coupler so as to have a masking effect. It is also possible to incorporate a development inhibitor-releasing coupler (the so-called DIR coupler) or a development inhibitor-releasing hydroquinone into each color-sensitive emulsion layer or the adjacent layer thereof. A development inhibitor released from these compounds with the progress of development brings about an interlayer effect, such as improvement of image sharpness, improvement of image grain fineness, improvement of monochromatic saturation, and the like.

The photographic emulsion layer according to the present invention or the adjacent layer thereof can further contain a coupler capable of releasing a development accelerator or nucleating agent with the progress of silver development, to thereby obtain such effects as improvement of photographic sensitivity, improvement of graininess of color images, increase of contrast, and the like.

According to the present invention, an ultraviolet absorbent can be added to an optional layer, and preferably to a layer containing the compound of the formula (I) or the adjacent layer thereof. The ultraviolet absorbent which can be used in this invention include the series of compounds listed in Research Disclosure 17643, VIII-C, and preferably benzotriazole derivatives represented by formula (XVII):

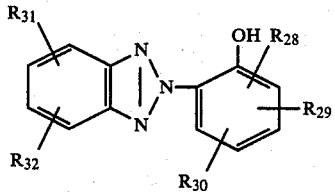

(XVII)

wherein $R_{28}$, $R_{29}$, $R_{30}$, $R_{31}$, and $R_{32}$ (which may be the same or different) each represents a hydrogen atom, an aromatic group or an aromatic group substituted with the substituent acceptable for $R_1$; and $R_{31}$ and $R_{32}$ together can form a 5- or 6-carbon-membered aromatic ring or a 5-or 6-carbon-membered aromatic ring, which can be substituted with the substituent acceptable for $R_1$. The substituent for the aromatic group or aromatic ring may be further substituted with the substituent acceptable for $R_1$.

The compounds represented by the formula (XVII) can be used individually or in combinations of two or more thereof. Compounds (UV-1) to (UV-19) shown below are specific examples of the ultraviolet absorbents of formula (XVII).

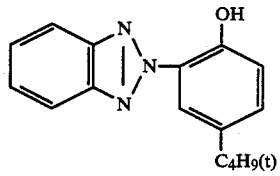

(UV-1)

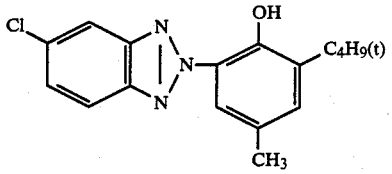

(UV-2)

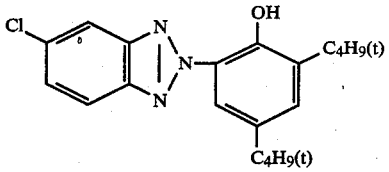

(UV-3)

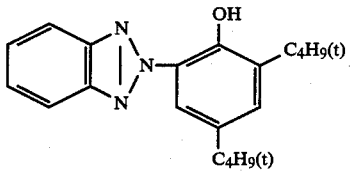

(UV-4)

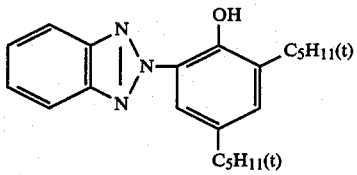

(UV-5)

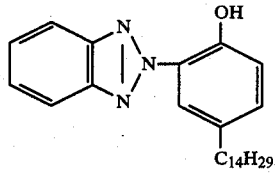

(UV-6)

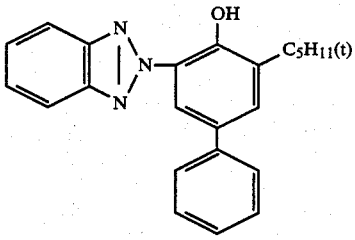

(UV-7)

-continued (UV-8)

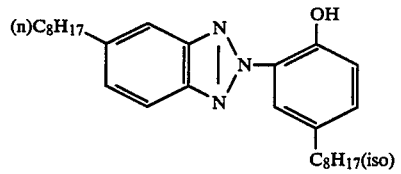

(UV-9)

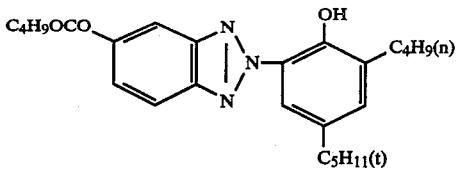

(UV-10)

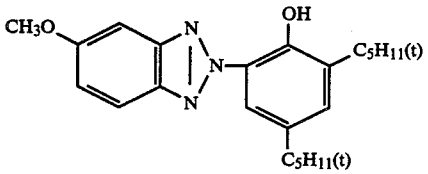

(UV-11)

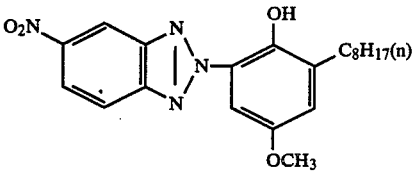

(UV-12)

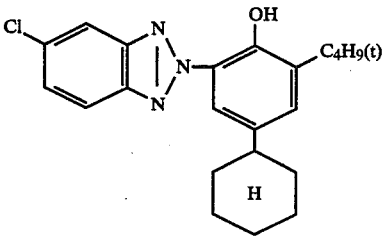

(UV-13)

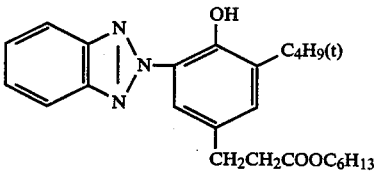

(UV-14)

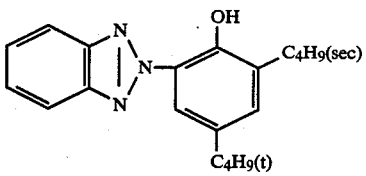

(UV-15)

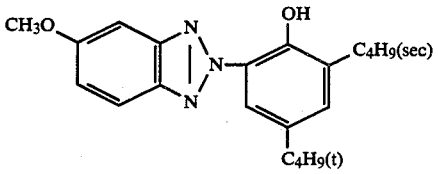

-continued (UV-16)

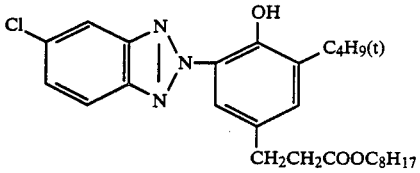

(UV-17)

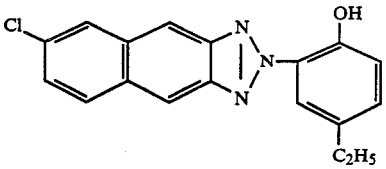

(UV-18)

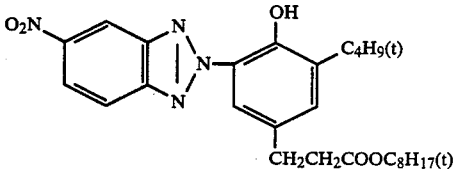

(UV-19)

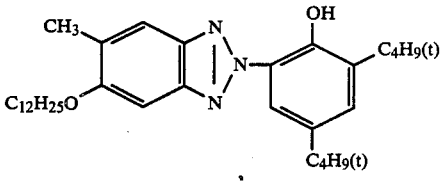

(UV-20)

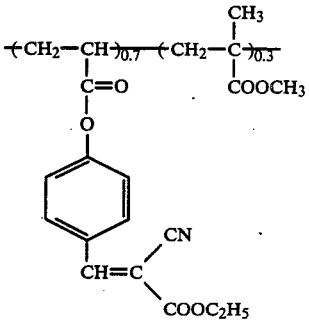

Processes for synthesizing the compounds represented by the above-described formula (XVII) and the specific examples of such compounds are described, e.g., in Japanese Patent Publication No. 29620/69, Japanese Patent Application (OPI) Nos. 151149/75 and 94233/79, U.S. Pat. No. 3,766,205, European Pat. No. 0057160, *Research Disclosure,* RD No. 22519, No. 225 (1983), etc. High polymeric ultraviolet absorbents as disclosed in Japanese Patent Application (OPI) Nos. 111942/83, 178351/83, 181041/83, 19945/84 and 23344/84 can also be used. A specific example of such high polymeric ultraviolet absorbents is shown above as Compound (UV-20). A combination of low molecular weight and high polymeric ultraviolet absorbents can be employed.

Similarly to the couplers, the above-described ultraviolet absorbent is dissolved in a high-boiling organic solvent or a low-boiling organic solvent or a mixture thereof and then dispersed in a hydrophilic colloid. The proportion of the high-boiling organic solvent to the ultraviolet absorbent is not particularly restricted, but usually ranges from 0 to 300% based on the weight of the ultraviolet absorbent. Use of a compound or compounds which are liquid at ambient temperature is preferred.

The combined use of the above-described ultraviolet absorbents of the formula (XVII) with the combination of the couplers according to the present invention can improve preservability, especially light-fastness, of dye images, especially a cyan dye image. The ultraviolet absorbent and the cyan coupler may be co-emulsified.

The ultraviolet absorbent is coated in an amount enough to impart light stability to a cyan dye image. However, an amount too large sometimes causes yellowing of unexposed areas (white background) of the color photographic light-sensitive materials. The amount of the ultraviolet absorbent to be coated is, therefore, preferably in the range of from $1\times10^{-4}$ to $2\times10^{-3}$ mol/m$^2$, and more preferably from $5\times10^{-4}$ to $1.5\times10^{-3}$ mol/m$^2$.

According to a usual light-sensitive layer structure of color papers, the ultraviolet absorbent is incorporated in either one of, and preferably both of, the layers adjacent to a red-sensitive emulsion layer containing a cyan coupler. When the ultraviolet absorbent is incorporated in an intermediate layer between a green-sensitive layer and a red-sensitive layer, it may be co-emulsified with a color mixing inhibitor. When the ultraviolet absorbent is incorporated in a protective layer, another protective layer may be independently provided as an outermost layer. Such an independent protective layer can contain a matting agent of an optional particle size.

In order to improve fastness to light, heat and humidity of a dye image obtained from the cyan coupler according to the present invention, an ultraviolet absorbent, preferably at least one of the compounds represented by formula (XVII) described hereinafter may be co-present with the cyan coupler.

Sterically hindered phenols as described in Japanese Patent Application (OPI) No. 48535 may also be present with or without the aforesaid ultraviolet absorbent. These compounds are preferably used in the form of a co-emulsion. Specific examples of sterically hindered phenols are shown below.

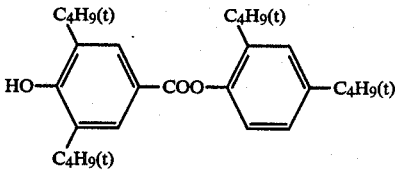

In order to improve preservability of dye images, particularly yellow and magenta images, a variety of organic type and metal complex type discoloration inhibitors can be used in combination. Organic discoloration inhibitors which can be used includes hydroquinones, gallic acid derivatives, p-alkoxyphenols, p-oxyphenols, and the like. With respect to dye image stabilizers, stain inhibitors or anti-oxidants, reference can be made to patents cited in *Research Disclosure, RD No.* 17643, VII-I or J. The metal complex type discoloration inhibitors are described, e.g., in *Research Disclosure,* RD No. 15162.

Fastness to heat and light of a yellow dye image can be improved by adding many compounds including phenols, hydroquinones, hydroxychromans, hydroxycoumarans, hindered amines and alkyl ethers, silyl ethers or hydrolyzable precursors thereof. Compounds effective for improving both light- and heat-fastness of a yellow dye image include those represented by formulae (XVIII) and (XIX):

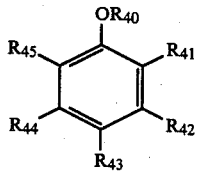

(XVIII)

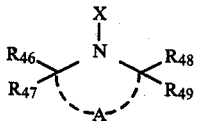

(XIX)

wherein $R_{40}$ represents a hydrogen atom, an aliphatic group, an aromatic group, a heterocyclic group or a substituted silyl group represented by the formula:

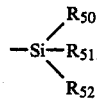

wherein $R_{50}$, $R_{51}$ and $R_{52}$ (which may be the same or different) each represents a substituted or unsubstituted aliphatic group, a substituted or unsubstituted aromatic group, a substituted or unsubstituted aliphatic oxy group or a substituted or unsubstituted aromatic oxy group, the substituent being the same as those acceptable for $R_1$; $R_{41}$, $R_{42}$, $R_{43}$, $R_{44}$ and $R_{45}$ (which may be the same or different) each represents a hydrogen atom, an alkyl group, an aryl group, an alkoxy group, a hydroxyl group, a mono- or dialkylamino group, an amino group or an acylamino group; $R_{46}$, $R_{47}$, $R_{48}$ and $R_{49}$ (which may be the same or different) each represents a hydrogen atom or an alkyl group; X represents a hydrogen atom, an aliphatic group, an acyl group, an aliphatic or aromatic sulfonyl group, an aliphatic or aromatic sulfinyl group, an oxy radical or a hydroxyl group, and A represents a non-metallic atomic group.

Specific examples of compounds represented by formulae (XVIII) and (XIX) are shown below, but are not limiting with respect to the present invention:

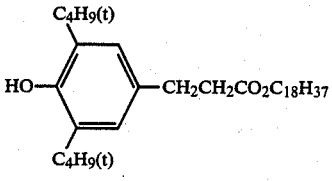

B-1

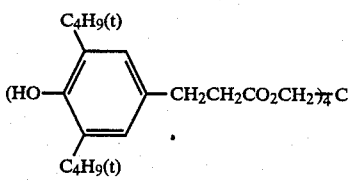

B-2

-continued
B-3
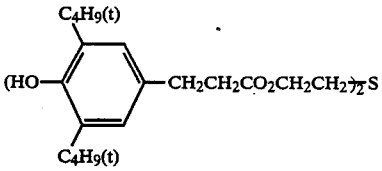
B-4
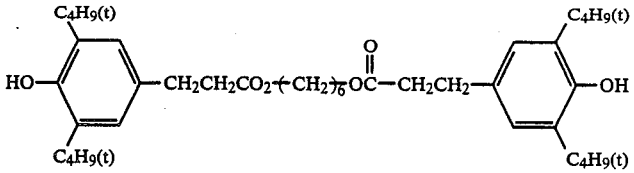
B-5
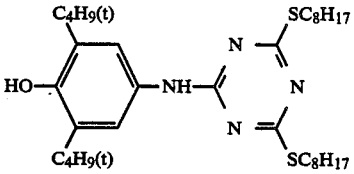
B-6
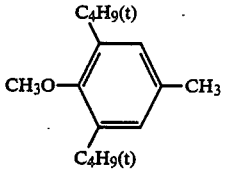
B-7
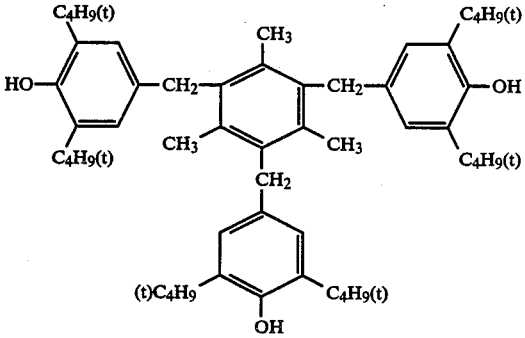
B-8
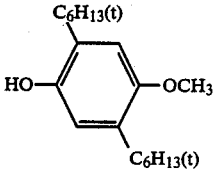
B-9
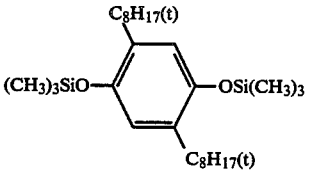
B-10
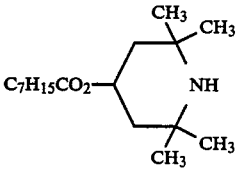
B-11
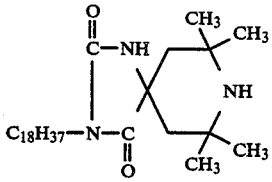
B-12
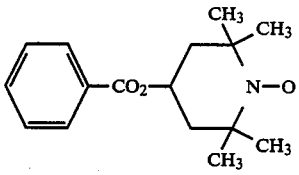
B-13
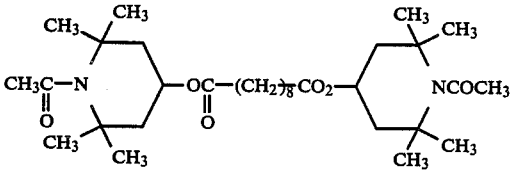
B-14
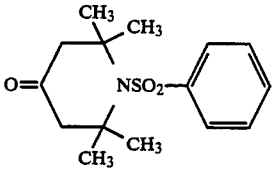
B-15
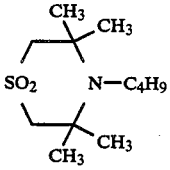
B-16
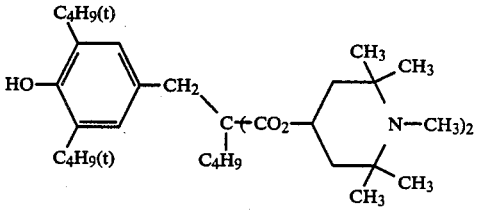

-continued

B-17

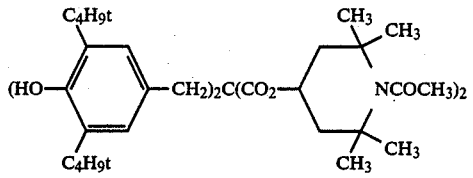

B-18

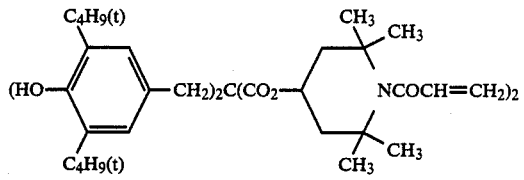

B-19

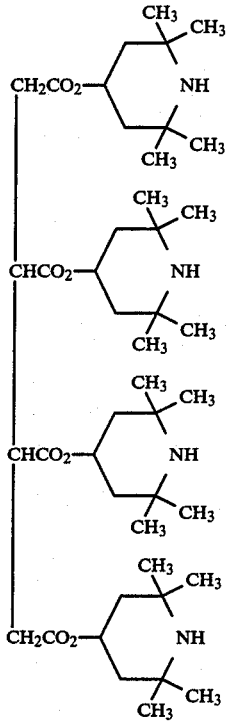

B-20

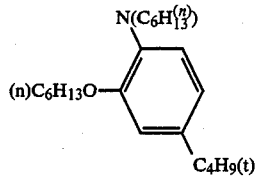

B-21

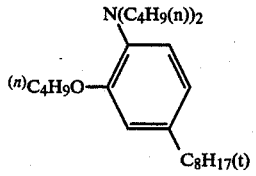

Processes for synthesizing the compounds of the formulae (XVIII) and (XIX) and other specific examples of these compounds are described in British Pat. Nos. 1,326,889, 1,354,313 and 1,410,846, U.S. Pat. Nos. 3,336,135 and 4,268,593, Japanese Patent Publication Nos. 1420/76 and 6623/77 and Japanese Patent Application (OPI) Nos. 114036/83and 5246/84.

The compounds represented by formulae (XVIII) and (XIX) may be used in combinations of two or more thereof, and can be used in combination with conventionally known discoloration inhibitors.

The amount of the compounds represented by the formulae (XVIII) and (XIX) varies depending on the type of the yellow coupler with which it is used in combination, but the desired results can usually be achieved by using them in an amount of from 0.5 to 200% by weight, and preferably from 2 to 150% by weight, with respect to the weight of the yellow coupler. The compounds (XVIII) or (XIX) are preferably co-emulsified with the yellow coupler of formula (IV).

The above-described wide variety of dye image stabilizers, stain inhibitors or antioxidants are also effective to improve preservability of the magenta dye obtained from the couplers represented by formula (II) or (III), or formulae (V) to (IX). However, compounds of the following formulae (XX) to (XXV) are particularly preferred because of their great effectiveness on improvement of light-fastness:

(XX)

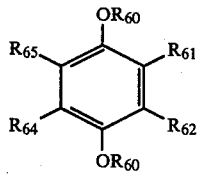

(XXI)

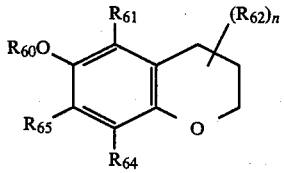

-continued (XXII)

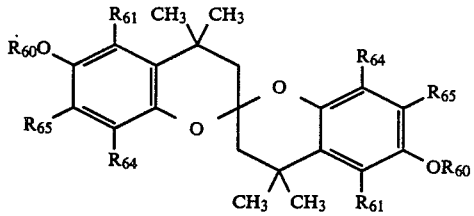

(XXIII)

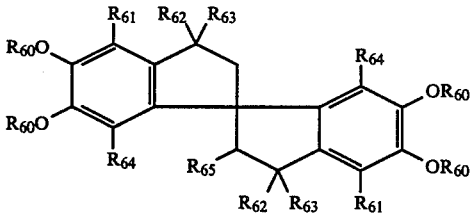

(XXIV)

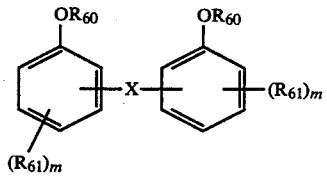

(XXV)

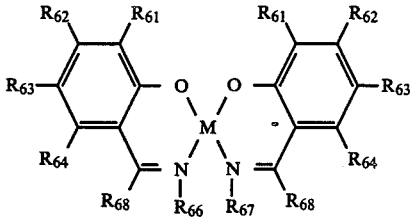

wherein $R_{60}$ has the same meaning as defined for $R_{40}$ of formula (XVIII); $R_{61}$, $R_{62}$, $R_{63}$, $R_{64}$, and $R_{65}$ (which may be the same or different) each represents a hydrogen atom, a substituted or unsubstituted aliphatic group, a substituted or unsubstituted aromatic group, an acylamino group, a mono- or dialkylamino group, an aliphatic or aromatic thio group, an aliphatic or aromatic oxycarbonyl group or $-OR_{40}$; $R_{40}$ and $R_{61}$ may be taken together to form a 5- or 6-membered ring; $R_{61}$ and $R_{62}$ together can form a 5- or 6-membered ring; X represents a divalent linking group; $R_{66}$ and $R_{67}$ (which may be the same or different) each represents a hydrogen atom, a substituted or unsubstituted aliphatic group, a substituted or unsubstituted aromatic ring or a hydroxyl group; $R_{68}$ represents a hydrogen atom, a substituted or unsubstituted aliphatic group or a substituted or unsubstituted aromatic ring; $R_{66}$ and $R_{67}$ may be taken together to form a 5- or 6-membered ring; M represents Cu, Co, Ni, Pd, or Pt; n represents 0 or an integer of from 1 to 6; m represents 0 or an integer of from 1 to 4; and when m or n is 2 or more, the substituted groups $R_{62}$ or $R_{61}$ may be the same or different; the substituent for the above-recited substituted aliphatic group or aromatic group is selected from those acceptable for $R_1$.

In formula (XXIV), examples of preferred X include

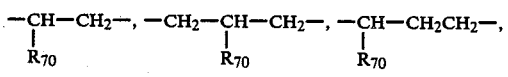

-continued

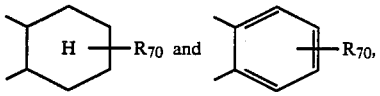

wherein $R_{70}$ represents a hydrogen atom or an alkyl group.

In formula (XXV), $R_{61}$ preferably includes groups capable of forming a hydrogen bond. The compounds of formula (XXV) wherein at least one $R_{62}$, $R_{63}$, and $R_{64}$ is a hydrogen atom, a hydroxyl group, an alkyl group, or an alkoxy group are preferred.

The substituents $R_{61}$ to $R_{68}$ preferably contain a total of at least 4 total carbon atoms.

Specific examples of compounds represented by formula (XX) to (XXV) are shown below, but are not limiting with respect to the present invention:

G-1

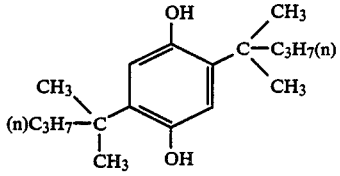

G-2

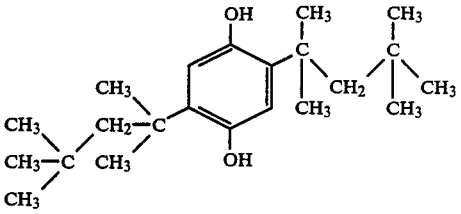

G-3

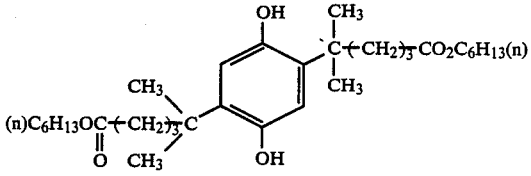

G-4

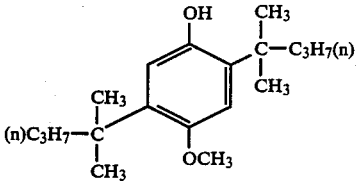

G-5

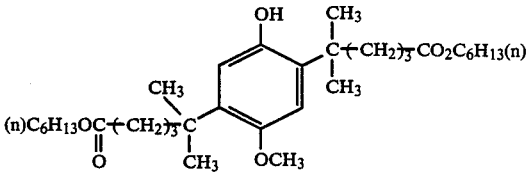

G-6

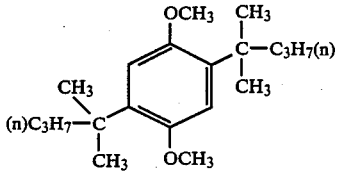

-continued
G-7
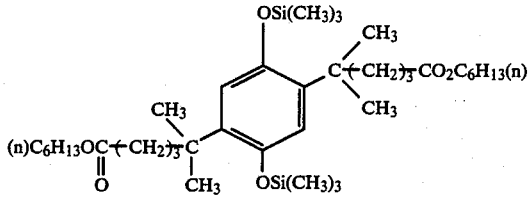
G-8
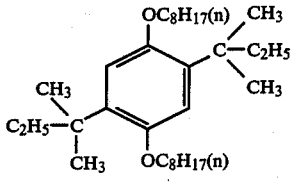
G-9
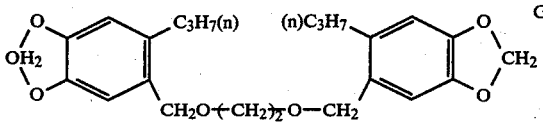
G-10
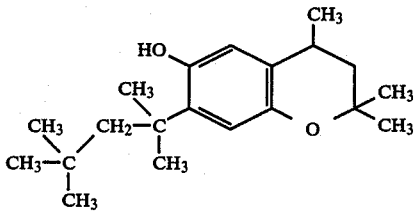
G-11
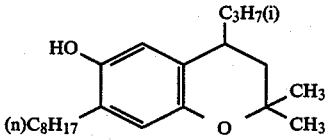
G-12
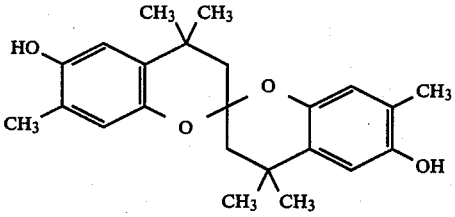
G-13
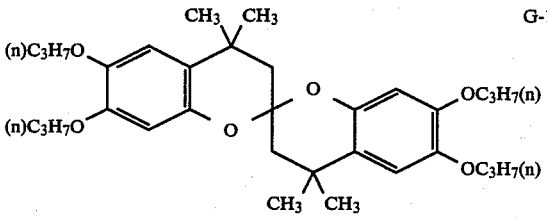
G-14
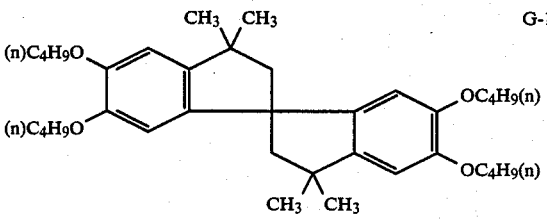
-continued
G-15
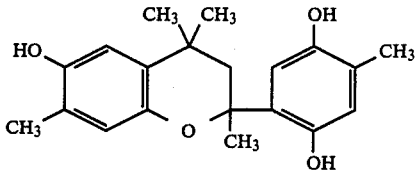
G-16
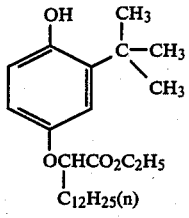
G-17
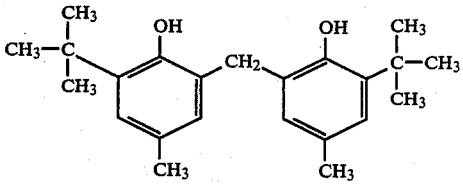
G-18
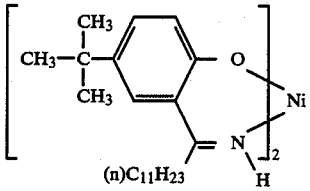
G-19
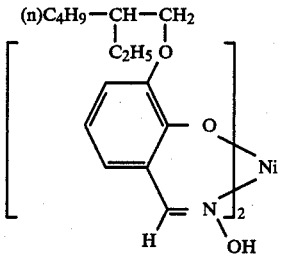
G-20
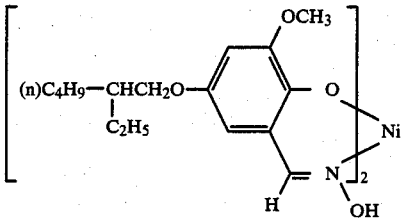
G-21
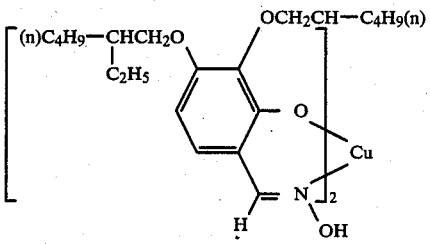

-continued

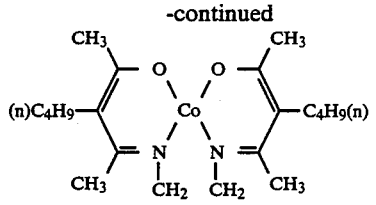

G-22

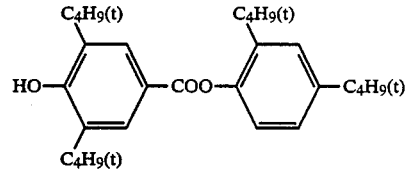

G-23

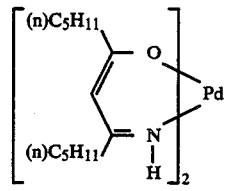

Other specific examples of compounds represented by formulae (XX) to (XXV) and processes for synthesizing the same are described in U.S. Pat. Nos. 3,336,135, 3,432,300, 3,573,050, 4,574,627;, 3,700,455, 3,764,337, 3,935,016, 3,982,944, 4,254,216 and 4,279,990, British Pat. Nos. 1,347,556, 2,062,888, 2,066,975 and 2,077,455, Japanese Patent Application No. 205278/83, Japanese Patent Application (OPI) Nos. 152225/77, 17729/78, 20327/78, 145530/79, 6321/80, 21004/80, 24141/83 and 10539/84 and Japanese Patent Publication Nos. 31625/73 and 12337/79.

Of the discoloration inhibitors according to the present invention, the compounds represented by formulae (XX) to (XXIV) are added to the magenta coupler of the present invention in an amount of from 10 to 200 mol%, and preferably from 30 to 100 mol%, with respect to the amount of the magenta coupler represented by formula (II) or (III). On the other hand, the compounds of the formula (XXV) is added in an amount of from 1 to 100 mol%, and preferably from 5 to 40 mol%, based on the magenta coupler of the present invention. These compounds are preferably co-emulsified with the magenta couplers.

For the purpose of preventing discoloration, there have been proposed (1) a method of covering a dye image with an oxygen-barrier layer composed of a substance having a low oxygen permeability, such as disclosed in Japanese Patent Application (OPI) Nos. 11330/74 and 57223/75, and (2) a method of providing a layer having an oxygen permeability of not more than 20 ml/m$^2$ hr atom on a support side of a dye image forming layer of color photographic light-sensitive materials. These technique can be applied to the present invention.

In order to improve fastness to light, heat and humidity of a dye image obtained from the cyan couplers according to the present invention, an ultraviolet absorbent, preferably at least one of the compounds of the formula (XVII), can be co-present with the cyan coupler. Further, the hindered phenols described in Japanese Patent Application (OPI) No. 48535/79 may also be co-present with or without the above-described ultraviolet absorbent. These compounds are preferably used in the form a co-emulsion. A specific example of the hindered phenols is shown below.

Silver halides which can be used in the silver halide emulsion layers according to the present invention are conventional and include silver chloride, silver bromide, silver chlorobromide, silver iodobromide and silver chloroiodobromide. Silver iodobromide containing from 2 to 20 mol% of silver iodide and silver chlorobromide containing from 10 to 50 mol% of silver bromide are preferred. There are no particular limitations to the crystal shapes, crystal structure, grain size, grain size distribution, and the like of silver halide grains. The silver halide grains may be either normal crystals or twinned crystals, and may be any of hexahedron, octahedron, and tetradecahedron. They may be tabular grains having a thickness of not more than 0.5 micron, a diameter of at least 0.6 micron and an average aspect ratio (diameter/thickness) of not less than 5, as described in *Research Disclosure* RD No. 22534.

The silver halide crystals may have a uniform structure, or may comprise a core and an outer shell being different in composition, or may have a layered structure. Further, they may comprise epitaxially fused silver halide crystals having different compositions, or they may comprise a mixture of grains having different crystals forms.

Moreover, the silver halide crystals may be either those forming a latent image predominantly on the surfaces of grains, or those forming a latent image predominantly in the interior thereof.

The silver halide grains can include both fine and coarse grains with its diameter of a projected surface area ranging from 0.1 μm or less to 3 μm or more. The silver halide emulsions may be either a mono-dispersed emulsion having a narrow size distribution or a poly-dispersed emulsion having a broad size distribution.

These silver halide grains can be prepared by known processes commonly employed in the art.

The silver halide emulsion can be sensitized according to generally employed chemical sensitization techniques, i.e., sulfur sensitizing, noble metal sensitization, or a combination thereof. The silver halide emulsion according to the present invention can also be imparted color-sensitivity to a desired wavelength region by using sensitizing dyes. The dyes which can advantageously be used in the present invention include methine dyes, such as cyanine dyes, hemicyanine dyes, rhodacyanine dyes, merocyanine dyes, oxonol dyes, hemioxonol dyes, etc., and styryl dyes. These sensitizing dyes can be used alone or in combinations of two or more thereof.

Supports which can be used in the present invention include a transparent support, such as a polyethylene terephthalate film and a cellulose triacetate film, and any of the following reflective supports, with the latter being preferred. The reflective supports include, for example, baryta paper, polyethylene-coated paper, polypropylene type synthetic paper and a transparent support which has provided thereon a reflective layer or is used in combination with a reflector, said transparent support including a glass plate, a polyester film, e.g., polyethylene terephthalate, cellulose triacetate and cellulose nitrate, a polyamide film, a polycarbonate film, a polystyrene film, and the like. These supports can appropriately be selected according to the intended use.

Each of the blue-sensitive, green-sensitive and red-sensitive emulsion layers according to the present invention is been spectrally sensitized with methine dyes or others so as to have the respective color sensitivity. Dyes which can be used for this purpose include cyanine dyes, merocyanine dyes, complex cyanine dyes, complex merocyanine dyes, holopolar cyanine dyes, hemicyanine dyes, styryl dyes and hemioxonol dyes, with cyanine dyes, merocyanine dyes, and complex merocyanine dyes being particularly useful. Any nuclei generally employed for cyanine dyes as basic heterocyclic nuclei can be applied to these dyes. Such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-enumerated nuclei to which an alicyclic hydrocarbon ring is fused; and the above-enumerated nuclei to which an aromatic hydrocarbon ring is fused, such as an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may be substituted at the carbon atom thereof.

The merocyanine dyes or complex merocyanine dyes can contain a 5- or 6-membered heterocyclic nucleus having a ketomethylene structure, such as a pyrazolin-5-one nucleus, a thiohydantoin nucleus, a 2-thiooxazolidine-2,4-dione nucleus, a thiazoline-2,4-dione nucleus, a rhodanine nucleus, a thiobarbituric acid nucleus, etc.

These sensitizing dyes can be used alone or in combinations thereof. A combination of sensitizing dyes is frequently employed for the purpose of supersensitization. Typical examples of such a combination are described, e.g., in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110618/77 and 109925/77.

In addition to the sensitizing dyes, the photographic emulsion can contain a dye which per se does not have a spectral sensitizing activity or a substance which does not substantially absorb visible lights, but which exhibit a supersensitizing activity when used in combination with the above sensitizing dyes.

The color photographic light-sensitive materials of the present invention can comprise, in addition to the above-described constituting layers, auxiliary layers, such as subbing layer, an intermediate layer, a protective layer, and the like. If necessary, a second ultraviolet absorbing layer can be formed between a red-sensitive silver halide emulsion layer and a green-sensitive silver halide emulsion layer. It is preferable to use the aforesaid ultraviolet absorbents in this second ultraviolet absorbing layer, but other known ultraviolet absorbents may also be employed.

Gelatin is used to advantage as a binder for the photographic emulsion or protective colloid, but other hydrophilic colloids may also be used.

The hydrophilic colloids other than gelatin include proteins, such as gelatin derivatives, graft polymers of gelatin with other high polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and a wide variety of synthetic hydrophilic high polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc., and copolymers comprising these homopolymer units.

Gelatin which can be used as a binder or protective colloid includes lime-processed gelatin, acid-processed gelatin, and enzyme-processed gelatin as described in *Bull. Soc. Sci. Photo. Japan,* No. 16, 30 (1966), and hydrolysis products or enzymatic degraded products of gelatin.

The photographic emulsion layers or other hydrophilic colloidal layers of the light-sensitive materials according to the present invention can contain a fluorescent brightening agent of the stilbene type, triazine type, oxazole type, coumarin type, or the like. These brightening agents may be either water-soluble or water-insoluble. In the latter case, they may be used in the form of a dispersion. Specific examples of usable fluorescent brightening agents are described, e.g., in U.S. Pat. Nos. 2,632,701, 3,269,840 and 3,359,102, British Pat. Nos. 852,075 and 1,319,763, and *Research Disclosure,* RD No. 17643, Vol. No. 176, p. 24, left col., lines 9 to 36, "Brighteners" (Dec. 1978).

When dyes or ultraviolet absorbents are incorporated into the hydrophilic colloidal layers of the light-sensitive materials, these compounds may fixed with mordants, such as cationic polymers. Examples of such polymers are described, e.g., in British Pat. No. 685,475, U.S. Pat. Nos. 2,675,316, 2,839,401, 2,882,156, 3,048,487, 3,184,309 and 3,445,231, West German Patent Application (OLS) No. 1,914,362, and Japanese Patent Application (OPI) Nos. 47624/75 and 71332/75.

The light-sensitive materials according to the present invention can contain hydroquinone derivatives, aminophenol derivatives, gallic acid derivatives, ascorbic acid derivatives, and the like as color fog preventing agents. Specific examples of these compounds are described, e.g., in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/85, 92989/75, 93928/75, 110337/75 and 146235/77 and Japanese Patent Publication No. 23813/75.

In addition, the color photographic light-sensitive materials of the present invention can further contain, if desired, various known photographic additives, such as stabilizers, antifoggants, surface active agents, couplers other than those recited in the present invention, filter dyes, irradiation-preventing dyes, developing agents, and the like. Specific examples of these additives are described, e.g., in *Research Disclosure,* RD No. 17643, supra.

In some cases, the silver halide emulsion layers or other hydrophilic colloidal layers may further contain an emulsion of silver halide fine grains having no substantial light sensitivity, for example, silver chloride, silver bromide, or silver chlorobromide having an average grain size of not more than 0.20 $\mu$m.

A color developing solution which can be used in the present invention is an alkaline aqueous solution consisting mainly of an aromatic primary amine color developing agent. Typical examples of the color developing agent are 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, and the like.

The color developing solution can contain buffer agents, such as sulfites, carbonates, borates or phosphates of alkali metals, development restrainers or antifoggants, such as bromides, iodides and organic antifoggants, and the like. If necessary, it can further contain water softeners, preservatives, such as hydroxylamine, organic solvents, such as benzyl alcohol and diethylene glycol, development accelerators, such as polyethylene glycol, quaternary ammonium salts and amines, color-forming couplers, competing couplers, fogging agents, such as sodium boron hydride, auxiliary developing agents, such as 1-phenyl-3-pyrazolidone, viscosity-imparting agents, the polycarboxylic acid type chelating agents disclosed in U.S. Pat. No. 4,083,723, the antioxidants disclosed in West German Patent Application (OLS) No. 2,622,950, and the like.

After color development, the photographic emulsion layer is usually subjected to bleaching. Bleaching may be carried out simultaneously with fixing, or these two procedures may be effected separately. Bleaching agents which can be used include compounds of polyvalent metals, e.g., iron (III), cobalt (III), chromium (VI), copper (II), etc., peracids, quinones, nitroso compounds, and the like. Examples of these bleaching agents are ferricyanides; bichromates; organic complex salts of iron (III) or cobalt (III) formed with aminopolycarboxylic acids, e.g., ethylenediaminetetraacetic acid, nitrilotriacetic acid, 1,3-diamino-2-propanoltetraacetic acid, etc., or an organic acid, e.g., citric acid, tartaric acid, malic acid, etc.; persulfates; permanganates; nitrosophenol; and the like. Of these, potassium ferricyanide, sodium(ethylenediaminetetraacetato)ferrate (III) and ammonium(ethylenediaminetetraacetato)ferrate (III) are particularly useful. The (ethylenediaminetetraacetato) iron (III) complexes are useful in either an independent bleaching bath or a combined bleach-fix bath.

After color development or bleach-fix processing, the light-sensitive material may be washed with water. Color development can be carried out at a temperature between 18° C. and 55° C., preferably 30° C. or higher, and more preferably 35° C. or higher. The time for development is preferably as short as possible within a range of from about 3.5 minutes to about 1 minute. For continuous development processing, replenishing is preferably conducted by using a replenisher in an amount of from 330 to 160 ml, and preferably 100 ml or less, per $m^2$ of an area to be processed. A content of benzyl alcohol in the developing solution is preferably 5 ml/l or less. Bleach-fix can be carried out at a temperature of from 18° C. to 50° C., and preferably 30° C. or higher. At temperatures of 35° C. or higher, the processing time can be shortened to 1 minutes or less, and the requisite amount of the replenisher can be reduced. The time required for washing after color development or bleach-fix is usually within 3 minutes, and can be shortened to within 1 minute by using a stabilizing bath.

Developed dyes can undergo discoloration due to not only light, heat or humidity, but also due to mold during preservation. Since cyan dye images particularly suffer from deterioration due to mold, use of an antifungal agent is desired. Examples of the antifungal agents are 2-thiazolylbenzimidazoles as described in Japanese Patent Application (OPI) No. 157244/82. The antifungal agent can be used at any stage by, for example, incorporating into the light-sensitive material or adding from the outside during the development processing steps, as long as it is ultimately present in the processed light-sensitive material.

The present invention will now be illustrated in greater detail with reference to examples, but it should be understood that these examples are not limiting the present invention.

EXAMPLE 1

Onto a paper support laminated with polyethylene on both sides were coated first (the innermost) to seventh (the outermost) layers according to the formulations shown in Table I to prepare color photographic light-sensitive materials (Samples A to S).

A coating solution for the first layer was prepared as follows. A hundred grams of the yellow coupler indicated in Table I was dissolved in a mixed solvent consisting of 166.7 ml of dibutyl phthalate (DBP) and 200 ml of ethyl acetate, and the solution was emulsified and dispersed in 800 g of a 10% aqueous solution of gelatin containing 80 ml of a 1% aqueous solution of sodium dodecylbenzenesulfonate. The resulting emulsion was mixed with 1,450 g of a blue-sensitive silver chlorobromide emulsion (bromine content: 80%; silver content: 66.7 g) to prepare a coating solution. Coating solutions for other layers were prepared in the same manner as described above. A hardener used in each layer was sodium 2,4-dichloro -6-hydroxy-s-triazine.

A spectral sensitizer used in each emulsion was as follows:

Blue-Sensitive Emulsion Layer: Sodium 3,3'-di-(γ-sulfopropyl)-selenacyanine ($2\times10^{-4}$ mol per mol of silver halide)

Green-Sensitive Emulsion Layer: Sodium 3,3'-di-(γ-sulfopropyl)-5,5'-diphenyl-9-ethyloxycarboxyanine ($2.5\times10^{-4}$ mol per mol of silver halide)

Red-Sensitive Emulsion Layer: Sodium 3,3'-di-(γ-sulfopropyl)-9-methylthiadicarbocyanine ($2.5\times10^{-4}$ mol per mol of silver halide)

The irradiation preventing dyes used in each emulsion layer were as follows:

Green-Sensitive Emulsion Layer:

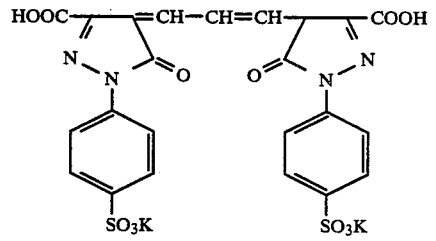

Red-Sensitive Emulsion Layer:

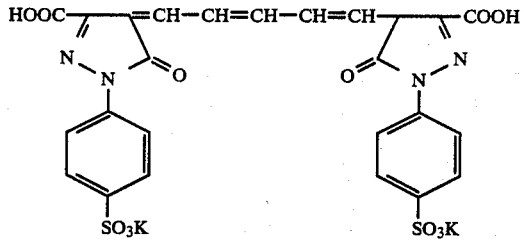

In Table I, TOP represents tri(n-octylphosphate), and compounds a to i have the following chemical structures:

a:

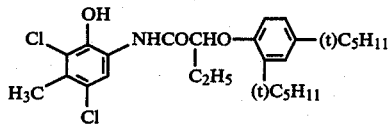

Cyan Coupler b:

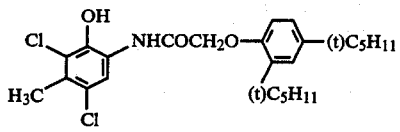

Cyan Coupler c:

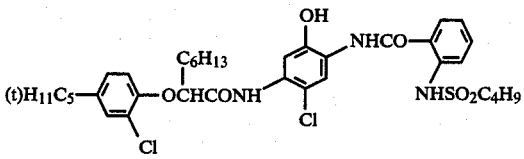

Cyan Coupler d:

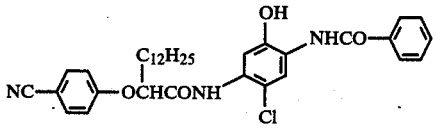

Cyan Coupler e:

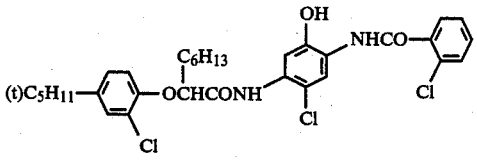

Cyan Coupler f:

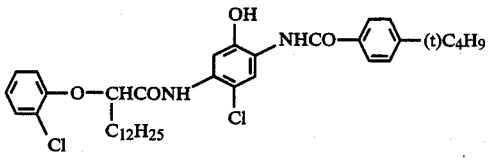

Cyan Coupler

-continued g: Compound G-1
h: Compound G-14
i: Compound B-18

Each of Samples A to M was exposed to light through a continuous wedge by means of an enlarging apparatus (Fuji Color H-ad 690, manufactured by Fuji Photo Film Co., Ltd.) and then subjected to the following development processing:

| Processing Step: | Temperature | Time |
|---|---|---|
| Development | 33° C. | 3'30" |
| Bleach-Fix | 33° C. | 1'30" |
| Washing | 28-35° C. | 3' |
| Drying | | |
| Developing Solution: | | |
| Trisodium nitrilotriacetate | | 2.0 g |
| Benzyl alcohol | | 15 ml |
| Diethylene glycol | | 10 ml |
| $Na_2SO_3$ | | 2.0 g |
| KBr | | 0.5 g |
| Hydroxylamine sulfate | | 3.0 g |
| 4-Amino-3-methyl-N—ethyl-N—[β-(methanesulfonamido)ethyl]-p-phenylenediamine sulfate | | 5.0 g |
| $Na_3CO_3$ (monohydrate) | | 30 g |
| Water to make | | 1 liter (pH 10.1) |
| Bleach-Fix Bath: | | |
| Ammonium thiosulfate (70 wt %) | | 150 ml |
| $Na_2SO_3$ | | 15 g |
| $NH_4[Fe(EDTA)]$ | | 55 g |
| EDTA.2Na | | 4 g |
| Water to make | | 1 liter (pH 6.9) |

Each of the thus development-processed samples was subjected to dark heat discoloration tests by preserving under the conditions of 100° C. for 1 week; 80° C. for 4 weeks; and 60° C., 70% RH (relative humidity) for 8 weeks. The yellow, magenta, and cyan densities of each sample before and after the test were determined by means of a Macbeth densitometer (Model RD-514) using blue light, green light and red light, respectively. Values determined after the test on the area having the initial density of 1.0 are shown in Table II.

The results in Table II indicate that the comparative samples underwent conspicuous reduction of the cyan density but substantially no reduction of the magenta and yellow densities due to dark heat discoloration. In practical use, reduction of only the cyan density results in the color balance of the whole print being lost, with the image inclining toward red. A similar phenomenon results under the condition of high humidity.

To the contrary, it can also be seen that Samples C to S according to the present invention underwent less reduction of the cyan density, and maintained good density balance of the yellow, magenta, and cyan colors, with only a visually inconspicuous discoloration behavior.

TABLE I

| Layer | Component (Coverage; mg/m$^2$) | Sample No. A | B | C | D | E | F | G | H | I | J | K | L | M | N | O | P | Q | R | S |
|---|---|---|---|---|---|---|---|---|---|---|---|---|---|---|---|---|---|---|---|---|
| Support | | paper support laminated with polyethylene on both sides therof. | | | | | | | | | | | | | | | | | | |
| 1st Layer (Blue-Sensitive Layer) | silver chlorobromide emulsion (Br: 80 Mol %) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) | 400 (as Ag) |
| | yellow coupler: | | | | | | | | | | | | | | | | | | | |
| | Y-10 | | | | | | | | | | | | 600 | | | | | | | |
| | Y-35 | | | | | | | | | | | 650 | | 650 | 650 | | 650 | 650 | 650 | |
| | Y-36 | 600 | 600 | 600 | 600 | 600 | 600 | 600 | 600 | 600 | 600 | | | | | | | | | |
| | Y-23 | | | | | | | | | | | | | | | | 750 | | | |
| | solvent for yellow coupler: | | | | | | | | | | | | | | | | | | | |
| | DPB | 1000 | 1000 | 1000 | 1000 | 1000 | 1000 | 1000 | 1000 | 1000 | 1000 | | | | 100 | 100 | 150 | 100 | 100 | 100 |
| | TOP | | | | | | | | | | | 1000 | 1000 | 1000 | | | | | | |
| | discoloration inhibitor: | | | | | | | | | | | | | | | | | | | |
| | i | 100 | 100 | 100 | 100 | 100 | 100 | 100 | 100 | 100 | 100 | 100 | 100 | 100 | 100 | 100 | 100 | 100 | 100 | 100 |
| 2nd Layer (Color Mixing Preventing Layer) | gelatin | 1500 | 1500 | 1500 | 1500 | 1500 | 1500 | 1500 | 1500 | 1500 | 1500 | 1500 | 1500 | 1500 | 1500 | 1500 | 1500 | 1500 | 1500 | 1500 |
| 3rd Layer (Green-Sensitive Layer) | silver chlorobromide emulsion (Br: 70 mol %) | 450 (as Ag) | 450 (as Ag) | 450 (as Ag) | 450 (as Ag) | 450 (as Ag) | 450 (as Ag) | 450 (as Ag) | 450 (as Ag) | 450 (as Ag) | 200 (as Ag) | 200 (as Ag) | 200 (as Ag) | 200 (as Ag) | 200 (as Ag) | 200 (as Ag) | 200 (as Ag) | 200 (as Ag) | 200 (as Ag) | 200 (as Ag) |
| | magenta coupler: | | | | | | | | | | | | | | | | | | | |
| | M-15 | | | | | | | | | | 300 | 300 | 300 | 300 | | | | | | |
| | M-18 | 350 | 350 | 350 | 350 | 350 | 350 | 350 | 350 | 350 | | | | | | | | | | |
| | M-50 | | | | | | | | | | | | | | 200 | 200 | 200 | | | |
| | M-51 | | | | | | | | | | | | | | | | | 200 | | |
| | M-53 | | | | | | | | | | | | | | | | | | 200 | |
| | M-54 | | | | | | | | | | | | | | | | | | | 200 |
| | solvent for magenta coupler: | | | | | | | | | | | | | | | | | | | |
| | TOP | 440 | 440 | 440 | 440 | 440 | 440 | 440 | 440 | 440 | 400 | 400 | 400 | 400 | 400 | 400 | 400 | 400 | 400 | 400 |
| | discoloration inhibitor: | | | | | | | | | | | | | | | | | | | |
| | g/h | 50/100 | 50/100 | 50/100 | 50/100 | 50/100 | 50/100 | 50/100 | 50/100 | 50/100 | 50/100 | 50/100 | 50/100 | 50/100 | | | | | | |
| | h | | | | | | | | | | | | | | 170 | 170 | 170 | 170 | 170 | 170 |
| 4th Layer (Ultra-violet Absorbing Layer) | gelatin | 2000 | 2000 | 2000 | 2000 | 2000 | 2000 | 2000 | 2000 | 2000 | 2000 | 2000 | 2000 | 2000 | 2000 | 2000 | 2000 | 2000 | 2000 | 2000 |
| | ultraviolet absorbent: | | | | | | | | | | | | | | | | | | | |
| | UV-3/UV-1/UV-4 | 15/45/90 | 15/45/90 | 15/45/90 | 15/45/90 | 15/45/90 | 15/45/90 | 15/45/90 | 15/45/90 | 15/45/90 | 15/45/90 | 15/45/90 | 15/45/90 | | | | | | | |
| | UV-3/UV-4/UV-16 | | | | | | | | | | | | | 15/45/140 | 14/45/140 | 15/45/140 | 15/45/140 | 15/45/140 | 15/45/140 | 15/45/140 |

TABLE I-continued

| Layer | Component (Coverage; mg/m²) | Sample No. A | B | C | D | E | F | G | H | I | J | K | L | M | N | O | P | Q | R | S |
|---|---|---|---|---|---|---|---|---|---|---|---|---|---|---|---|---|---|---|---|---|
| | solvent for ultraviolet absorbent: | | | | | | | | | | | | | | | | | | | |
| 5th Layer (Red-Sensitive Layer) | DBP | 60 | 60 | 60 | 60 | 60 | 60 | 60 | 60 | 60 | 60 | 60 | 60 | 60 | 60 | 60 | 60 | 60 | 60 | 60 |
| | silver chlorobromide emulsion (Br: 50 mol %) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) | 300 (as Ag) |
| | cyan coupler: | | | | | | | | | | | | | | | | | | | |
| | a | 400 | | | | | | | | | | | | | | | | | | |
| | a/b | | 200/200 | | | | | | | | | | | | | | | | | |
| | C-1 | | | 400 | | | | | | | 400 | | | 400 | | | | | | |
| | a/C-1 | | | | 100/300 | | | | | | 100/300 | | | | | | | | | |
| | C/C-1 | | | | | 100/300 | | | | | | 100/300 | | | | | | | | |
| | d/C-1 | | | | | | 100/300 | | | | | | | | | | | | | |
| | e/C-1 | | | | | | | 100/300 | | | | | 100/300 | | | | | | | |
| | f/C-1 | | | | | | | | 100/300 | | | | | | | | | | | |
| | C-1/e | | | | | | | | | | | | | | 300/100 | 300/100 | 300/100 | 300/100 | 300/100 | 300/100 |
| | solvent for cyan coupler: | | | | | | | | | | | | | | | | | | | |
| | DBP | 240 | 240 | 240 | 240 | 240 | 240 | 240 | 240 | 240 | 240 | 240 | 240 | 240 | 240 | 240 | 240 | 240 | 240 | 240 |
| | ultraviolet absorbent: | | | | | | | | | | | | | | | | | | | |
| | UV-3/UV-1/UV-4 | | 20/50/60 | | | | | | | 20/50/60 | | | 20/50/60 | 20/50/60 | | 20/50/60 | | | | |
| 6th Layer (Ultra-violet Absorbing Layer) | gelatin | 1500 | 1500 | 1500 | 1500 | 1500 | 1500 | 1500 | 1500 | 1500 | 1500 | 1500 | 1500 | 1500 | 1500 | 1500 | 1500 | 1500 | 1500 | 1500 |
| | ultraviolet absorbent: | | | | | | | | | | | | | | | | | | | |
| | UV-3/UV-1 UV-4 | 50/150/300 | 50/150/300 | 50/150/300 | 50/150/300 | 50/150/300 | 50/150/300 | 50/150/300 | 50/150/300 | 50/150/300 | 50/150/300 | 50/150/300 | 50/150/300 | | | | | | | |
| | UV-3/UV-4 UV-16 | | | | | | | | | | | | | 50/150/400 | | | | | | |
| | UV-3/UV-4 | | | | | | | | | | | | | | 50/150/400 | 50/150/40 | 50/150/400 | 50/150/400 | 50/150/400 | 50/150/400 |
| | solvent for ultraviolet absorbent: | | | | | | | | | | | | | | | | | | | |
| | DBP | 200 | 200 | 200 | 200 | 200 | 200 | 200 | 200 | 200 | 200 | 200 | 200 | 200 | 200 | 200 | 200 | 200 | 200 | 200 |

TABLE I-continued

| Layer | Component (Coverage; mg/m$^2$) | Sample No. A | B | C | D | E | F | G | H | I | J | K | L | M | N | O | P | Q | R | S |
|---|---|---|---|---|---|---|---|---|---|---|---|---|---|---|---|---|---|---|---|---|
| 7th Layer (Protective Layer) | gelatin | 1500 | 1500 | 1500 | 1500 | 1500 | 1500 | 1500 | 1500 | 1500 | 1500 | 1500 | 1500 | 1500 | 1500 | 1500 | 1500 | 1500 | 1500 | 1500 |
| Remark | * comparison<br>** invention | * | * | ** | ** | ** | ** | ** | ** | ** | ** | ** | ** | ** | ** | ** | ** | ** | ** | ** |

TABLE II

| Sample No. | Remark | 100° C. × 1 week | | | 80° C. × 4 weeks | | | 60° C. × 8 weeks | | |
|---|---|---|---|---|---|---|---|---|---|---|
| | | $D_B$* | $D_G$* | $D_R$* | $D_B$* | $D_G$* | $D_R$* | $D_B$* | $D_G$* | $D_R$* |
| A | comparison | 1.00 | 0.99 | 0.52 | 1.00 | 0.99 | 0.65 | 0.97 | 0.98 | 0.70 |
| B | " | 1.00 | 1.00 | 0.51 | 0.99 | 1.00 | 0.66 | 0.98 | 0.97 | 0.72 |
| C | invention | 1.00 | 1.00 | 0.78 | 1.00 | 1.00 | 0.84 | 0.98 | 0.96 | 0.89 |
| D | " | 1.00 | 0.99 | 0.69 | 1.00 | 0.99 | 0.77 | 0.97 | 0.95 | 0.81 |
| E | " | 1.00 | 1.00 | 0.92 | 0.99 | 1.00 | 0.95 | 0.98 | 0.97 | 0.91 |
| F | " | 1.00 | 1.00 | 0.90 | 1.00 | 1.00 | 0.92 | 0.96 | 0.96 | 0.93 |
| G | " | 1.00 | 1.00 | 0.94 | 1.00 | 0.99 | 0.94 | 0.96 | 0.95 | 0.94 |
| H | " | 0.99 | 1.00 | 0.91 | 0.99 | 1.00 | 0.93 | 0.97 | 0.96 | 0.93 |
| I | " | 1.00 | 0.99 | 0.73 | 1.00 | 0.99 | 0.80 | 0.96 | 0.97 | 0.88 |
| J | " | 1.00 | 1.00 | 0.80 | 1.00 | 0.99 | 0.86 | 0.97 | 0.99 | 0.90 |
| K | " | 0.99 | 1.00 | 0.91 | 0.99 | 1.00 | 0.93 | 0.98 | 0.98 | 0.92 |
| L | " | 1.00 | 1.00 | 0.95 | 1.00 | 1.00 | 0.95 | 0.97 | 0.99 | 0.94 |
| M | " | 1.00 | 0.99 | 0.77 | 1.00 | 0.99 | 0.85 | 0.97 | 0.99 | 0.86 |
| N | " | 1.00 | 1.00 | 0.95 | 0.99 | 1.00 | 0.95 | 0.99 | 0.99 | 0.94 |
| O | " | 1.00 | 1.00 | 0.97 | 0.99 | 1.00 | 0.98 | 0.98 | 0.99 | 0.97 |
| P | " | 0.99 | 1.00 | 0.95 | 1.00 | 1.00 | 0.96 | 0.99 | 0.99 | 0.95 |
| Q | " | 1.00 | 0.99 | 0.95 | 1.00 | 1.00 | 0.95 | 0.98 | 0.98 | 0.94 |
| R | " | 1.00 | 1.00 | 0.94 | 0.99 | 1.00 | 0.95 | 0.98 | 0.97 | 0.94 |
| S | " | 1.00 | 1.00 | 0.95 | 1.00 | 0.99 | 0.95 | 0.98 | 0.98 | 0.94 |

(Note)
*$D_B$, $D_G$, and $D_R$ represent the density of yellow, magenta, and cyan, respectively.

EXAMPLE 2

Onto a cellulose triacetate support were coated the following first (the innermost) to 6th (the outermost) layers to prepare multilayer color photographic light-sensitive materials (Samples 1 to 3).

TABLE III

| Layer | Component | Coverage (mg/m²) |
|---|---|---|
| Support | cellulose triacetate | |
| 1st Layer | silver iodobromide emulsion (silver iodide: 0.2 mol %) | 1000 (as Ag) |
| | gelatin | 2200 |
| | yellow coupler*1 | 1200 |
| | solvent for coupler*2 | 600 |
| 2nd Layer | gelatin | 500 |
| 3rd Layer (Red-Sensitive Layer) | silver chlorobromide emulsion (silver bromide: 30 mol %) | 500 (as Ag) |
| | gelatin | 2900 |
| | sensitizing dye*3 | 0.2 |
| | cyan coupler*4 | 1500 |
| | ultraviolet absorbent*5 | 400 |
| | solvent for coupler*6 | 700 |
| 4th Layer | gelatin | 500 |
| 5th Layer (Green-Sensitive Layer) | silver chlorobromide emulsion (silver bromide: 30 mol %) | 500 (as Ag) |
| | gelatin | 500 |
| | sensitizing dye*7 | 2.1 |
| | magenta coupler*8 | 600 |
| | solvent for coupler*9 | 110 |
| 6th Layer (Protective Layer) | gelatin | 750 |

Note
*1Compound Y-1
*2Dibutyl phthalate
*3Potassium 2-[5-{4-(6-methyl-3-pentylbenzothiazolin-2-ylidene)2-methyl-2-butenylidene}-3-rhodanine]acetate
*4In accordance with the formulation shown in Table IV
*5UV-2/UV-3/UV-4 (3:3:4 by weight)
*6In accordance with the formulation shown in Table IV
*7Triethylammonium 4-[6-chloro-5-cyano-1-ethyl-2-(3-[5-phenyl-3-(4-sulfonatobutyl)benzoxazolin-2-ylidene]-1-propenyl)benzimidazolium-3-]-butanesulfonate
*8Compound M-18
*9Tricresyl phosphate

TABLE IV

| Sample No. | Coupler | Amount of Coupler (× $10^{-1}$ mol/Ag-mol) | Solvent for Coupler | | |
|---|---|---|---|---|---|
| 1 (comparison) | a | 4.0 | S-1* (60%) | + | S-2** (40%) |
| 2 | a/C-1 | 1.0/3.0 | S-1* (60%) | + | S-2** (40%) |
| 3 | C-1 | 4.0 | S-1* (60%) | + | S-2** (40%) |

Note
*Dibutyl phthalate
**2,4-Di-tert-amylphenol

Each of Samples 1 to 3 was exposed to blue, green, and red lights through a continuous wedge, and then subjected to the following development processing.

| Development Processing: step | Temperature | Time |
|---|---|---|
| Color Development | 36° C. | 3 mins. |
| Stop | 36° C. | 40 sec. |
| First Fixing | 36° C. | 40 sec. |
| Bleaching | 36° C. | 1 min. |
| Second Fixing | 36° C. | 40 sec. |
| Washing | 30° C. | 30 sec. |

| | |
|---|---|
| **Color Developing Solution:** | |
| Sodium sulfite | 5 g |
| 4-Amino-3-methyl-N,N—diethylaniline | 20 g |
| Sodium carbonate | 20 g |
| Potassium bromide | 2 g |
| Water to make | 1 liter (pH 10.5) |
| **Stop Solution:** | |
| 6N Sulfuric acid | 50 ml |
| Water to make | 1 liter (pH 1.0) |
| **Fixer:** | |
| Ammonium thiosulfate | 60 g |
| Sodium sulfite | 2 g |
| Sodium hydrogensulfite | 10 g |
| Water to make | 1 liter (pH 5.8) |
| **Bleaching Solution:** | |
| Potassium ferricyanide | 30 g |
| Potassium bromide | 15 g |
| Water to make | 1 liter (pH 6.5) |

Each of the thus processed samples was determined for its optical density to red light to obtain gamma and the maximum density as shown in Table V.

The hue of each developed film was evaluated by determining a spectral density of the cyan dye image by the use of an automatic recording spectrophotometer (Model 340, manufactured by Hitachi, Ltd.) to obtain the maximum density wavelength ($\lambda_{max}$) and the half value width of absorption in short wavelengths ($\lambda\frac{1}{2}$). The results obtained are shown in Table V.

Further, the fastness of the cyan dye image of each processed film was evaluated by allowing the sample at 100° C. in the dark for 3 days; allowing the sample at 60° C. and 70% RH in the dark for 6 weeks; or exposing the sample to light for 7 days using a xenone testor (20,000 lux). The fastness was expressed in terms of percent reduction of density in the area having the initial density of 1.0. The results obtained are shown in Table V. Cyan density reduction was based on the density in the state where light decolorization was restored.

From the results of Table V, it can be seen that not only excellent color forming properties (i.e., high gamma values and high maximum densities) but also excellent dye image fastness can be attained by the use of the coupler according to the present invention as compared with the use of comparative known couplers.

TABLE V

| Sample No. | Hue* $\lambda_{mas}$ (nm) | Hue* $\lambda\frac{1}{2}$ (nm) | Color-Forming Property Gamma | Color-Forming Property Maximum Density | Dye Image Fastness (% Reduction) 100° C. × 3 Days | 60° C., 70% RH × 6 Weeks | Light (Xenon) × 7 Days |
|---|---|---|---|---|---|---|---|
| 1 (Comparison) | 670 | 70 | 3.58 | 3.45 | 52 | 23 | 14 |
| 2 (Invention) | 669 | 70 | 3.64 | 3.53 | 35 | 16 | 12 |
| 3 (Invention) | 670 | 70 | 3.76 | 3.55 | 24 | 11 | 10 |

Note
*$\lambda\frac{1}{2}$ is a difference between the wavelength showing 50% intensity of the absorption maximum and the wavelength showing the maximum density.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one red-sensitive emulsion layer, at least one green-sensitive emulsion layer and at least one blue-sensitive emulsion layer, wherein a coupler represented by the formula (I), a coupler represented by the formula (III), and a coupler represented by the formula (IV) are present in light-sensitive emulsion layers having sensitivities to different colors:

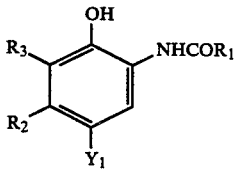

(I)

wherein $R_1$ represents a substituted or unsubstituted aliphatic group, a substituted or unsubstituted aryl group, or a substituted or unsubstituted heterocyclic group; $R_2$ represents an alkyl group having 2 or more carbon atoms or an alkyl group substituted with an aryl group, an alkoxy group, an aryloxy group, an acylamino group, an alkylthio group, an arylthio group, an alkylsulfonyl group, an arylsulfonyl group, or an arylseleno group; $R_3$ represents a hydrogen atom, a halogen atom, or a substituted or unsubstituted alkyl, aryl, alkoxy, or acylamino group; $Y_1$ represents a hydrogen atom or a group releasable upon coupling with an oxidized product of a developing agent; $R_2$, $R_3$ or $Y_1$ may form a dimer or a higher polymer;

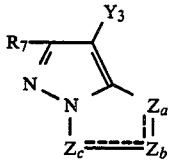

(III)

wherein $R_7$ represents a hydrogen atom or an organic residual group bonded by carbon, oxygen, sulfur, nitrogen, phosphorus or silicon; $Y_3$ represents a hydrogen atom or a group releasable upon coupling with an oxidized product of a developing agent; $Z_a$, $Z_b$ and $Z_c$ each represents a methine group, a substituted methine group, =N—, or —NH—; and $R_7$, $Y_3$ or the methine group as represented by $Z_a$, $Z_b$ or $Z_c$ may form a dimer or a higher polymer;

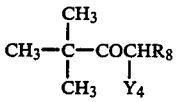

(IV)

wherein $R_8$ represents a substituted or unsubstituted N-phenylcarbamoyl group; $Y_4$ represents a hydrogen atom or a group releasable upon coupling with an oxidized product of a developing agent; and $R_8$ or $Y_4$ may form a dimer or a higher polymer, wherein the coupler represented by the formula (I) is present in a red-sensitive emulsion layer, the coupler represented by the formula (III) is present in a green-sensitive emulsion layer, and the coupler represented by the formula (IV) is present in a blue-sensitive emulsion layer.

2. A silver halide color photographic light-sensitive material as in claim 1, wherein $R_1$ in formula (I) is a substituted or unsubstituted alkyl group.

3. A silver halide color photographic light-sensitive material as in claim 2, wherein $R_1$ in the formula (I) is a substituted aryloxyalkyl group.

4. A silver halide color photographic light-sensitive material as in claim 1, wherein $R_3$ in formula (I) is a hydrogen atom or a halogen atom.

5. A silver halide color photographic light-sensitive material as in claim 1, wherein $Y_1$ in formula (I) is a hydrogen atom or a halogen atom.

6. A silver halide color photographic light-sensitive material as in claim 5, wherein $Y_1$ in formula (I) is a chlorine atom.

7. A silver halide color photographic light-sensitive material as in claim 1, wherein the coupler represented by formula (III) is represented by formula (V), (VI), (VII), (VIII), or (IX):

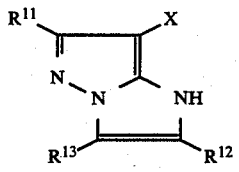
(V)

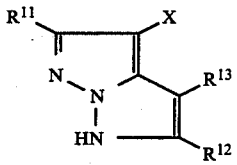
(VI)

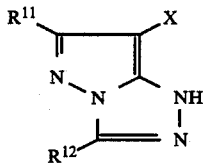
(VII)

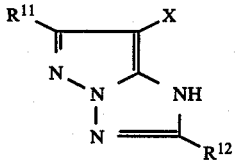
(VIII)

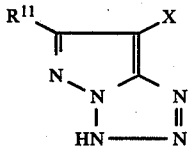
(IX)

wherein $R^{11}$, $R^{12}$, and $R^{13}$ each represents a substituted or unsubstituted aliphatic group, a substituted or unsubstituted aromatic group, a substituted or unsubstituted heterocyclic group, RO—, $$\underset{\underset{O}{\|}}{RC}-,\ \underset{\underset{O}{\|}}{RCO}-,\ RSO-,\ RSO_2-,\ RSO_2NH-,\ \underset{\underset{O}{\|}}{RCNH}-,$$

$$RNH-,\ RS-,\ \underset{\underset{O}{\|}}{ROCNH}-,$$

wherein R represents an aliphatic group, an aromatic group, a heterocyclic group, an aliphatic oxy group, an aromatic oxy group, an acyl group, an ester group, an amido group, an imido group, an ureido group, an aliphatic or aromatic sulfonyl group, an aliphatic or aromatic thio group, a hydroxyl group, a cyano group, a carboxyl group, a nitro group, a sulfo group or a halogen atom, a hydrogen atom, a cyano group, an imido group, a carbamoyl group, a sulfamoyl group, an ureido group, a sulfamoylamino group, an N-substituted carbamoyl group, an N-substituted sulfamoyl group, an N-substituted ureido group or an N-substituted sulfamoylamino group; X has the same meaning as $Y_3$; and either one of $R^{11}$, $R^{12}$, $R^{13}$, and X may be a divalent group to form a dimer or may be a divalent group which links a high polymeric main chain and a coupling group.

8. A silver halide color photographic light-sensitive material as in claim 7, wherein the coupler represented by the formula (III) is represented by the formula (VIII).

9. A silver halide color photographic light-sensitive material as in claim 2, wherein $R^{11}$, $R^{12}$ and $R^{13}$ are each a hydrogen atom, a halogen atom, the substituent specified by R, RO—, RCONH—, $RSO_2NH$—, RNH—, RS—, or ROCONH.

10. A silver halide color photographic light-sensitive material as in claim 1, wherein $R_8$ in the formula (IV) is represented by formula (IVA):

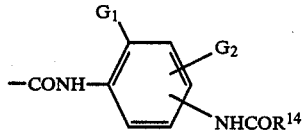
(IVA)

wherein $G_1$ represents a halogen atom or an alkoxy group; $G_2$ represents a hydrogen atom, a halogen atom, or a substituted or unsubstituted alkoxy group; and $R^{14}$ represents a substituted or unsubstituted alkyl group.

11. A silver halide color photographic light-sensitive material as in claim 1, wherein $Y_4$ in the formula (IV) is represented by formula (X), (XI), (XII), or (XIII):

$$-\underset{\underset{OR_{20}}{|}}{}- \qquad \text{(X)}$$

wherein $R_{20}$ represents a substituted or unsubstituted aryl group, or a substituted or unsubstituted heterocyclic group;

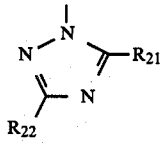
(XI)

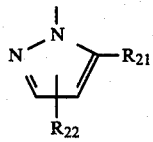
(XII)

wherein $R_{21}$ and $R_{22}$ each represents a hydrogen atom, a halogen atom, a carboxylic ester group, an amino group, an alkyl group, an alkylthio group, an alkoxy group, an alkylsulfonyl group, an alkylsulfinyl group, a carboxyl group, a sulfo group, a substituted or unsubstituted phenyl group or a substituted or unsubstituted heterocyclic group; and (XIII)

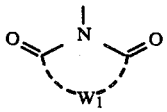

wherein $W_1$ represents a non-metallic atom group necessary to form a 4-, 5- or 6-membered ring together with

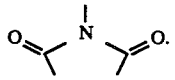

12. A silver halide color photographic light-sensitive material as in claim 11, wherein formula (XIII) is represented by formula (XIV), (XV), or (XVI):

(XIV)

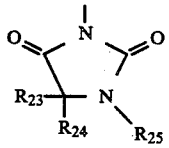

(XV)

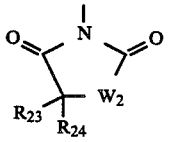

(XVI)

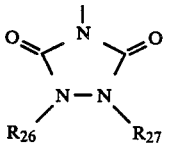

wherein $R_{23}$ and $R_{24}$ each represents a hydrogen atom, an alkyl group, an aryl group, an alkoxy group, an aryloxy group or a hydroxyl group; $R_{25}$, $R_{26}$, and $R_{27}$ each represents a hydrogen atom, an alkyl group, an aryl group, an aralkyl group, or an acyl group; and $W_2$ represents an oxygen atom or a sulfur atom.

13. A silver halide color photographic light-sensitive material as in claim 1, wherein the coupler represented by formula (I), (III), or (IV) is present in an amount of from 0.1 to 1.0 mole per mole of silver halide on an individual basis.

14. A silver halide color photographic light-sensitive material as in claim 1, wherein the coupler represented by formula (I), (III), or (IV) is present in an amount of from 0.1 to 0.5 mole per mole of silver halide on an individual basis.

15. A silver halide color photographic light-sensitive material as in claim 1, wherein the coupler represented by the formula (I) is used in combination with an ultraviolet absorbent.

16. A silver halide color photographic light-sensitive material as in claim 15, wherein the ultraviolet absorbent is represented by formula (XVII):

(XVII)

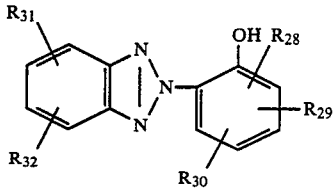

wherein $R_{28}$, $R_{29}$, $R_{30}$, $R_{31}$, and $R_{32}$ each represents a hydrogen atom, an aromatic group or a substituted aromatic group; and $R_{31}$ and $R_{32}$ together can form a substituted or unsubstituted 5- or 6-carbon-membered aromatic ring.

17. A silver halide color photographic light-sensitive material as in claim 15, wherein the ultraviolet absorbent is used in an amount of from $1\times10^{-4}$ to $2\times10^{-3}$ mole/$m^2$.

18. A silver halide color photographic light-sensitive material as in claim 15, wherein the ultraviolet absorbent is used in an amount of from $5\times10^{-4}$ to $1.5\times10^{-3}$ mole/$m^2$.

19. A silver halide color photographic light-sensitive material as in claim 1, wherein the coupler represented by formula (IV) is used in combination with a discoloration inhibitor selected from compounds represented by formula (XVIII) to (XIX):

(XVIII)

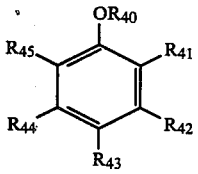

wherein $R_{40}$ represents a hydrogen atom, an aliphatic group, an aromatic group, a heterocyclic group, or a substituted silyl group represented by the formula:

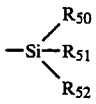

wherein $R_{50}$, $R_{51}$ and $R_{52}$ each represents a substituted or unsubstituted aliphatic group, a substituted or unsubstituted aromatic group, a substituted or unsubstituted aliphatic oxy group, or a substituted or unsubstituted aromatic oxy group; $R_{41}$, $R_{42}$, $R_{43}$, $R_{44}$ and $R_{45}$ each represents a hydrogen atom, an alkyl group, an aryl group, an alkoxy group, a hydroxyl group, a mono- or dialkylamino group, an amino group, or an acylamino group;

(XIX)

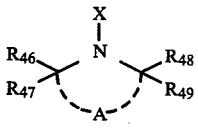

wherein $R_{46}$, $R_{47}$, $R_{48}$ and $R_{49}$ each represents a hydrogen atom or an alkyl group; X represents a hydrogen atom, an aliphatic group, an acyl group, an aliphatic or aromatic sulfonyl group, an aliphatic or aromatic sulfinyl group, a hydroxyl radical or a hydroxyl group; and A represents a non-metallic atomic group is group forming a 5- or 7-membered ring.

20. A silver halide color photographic light-sensitive material as in claim 19, wherein the discoloration inhibitor is used in an amount of from 0.5 to 200% by weight based on the coupler represented by formula (IV).

21. A silver halide color photographic light-sensitive material as in claim 19, wherein the discoloration inhibitor is used in an amount of from 2 to 150% by weight with respect to the coupler represented by formula (IV).

22. A silver halide color photographic light-sensitive material as in claim 1, wherein the coupler represented by formula (III) is used in combination with a discoloration inhibitor selected from compounds represented by the formulae (XX), (XXI), (XXII), (XXIII), (XXIV), and (XXV):

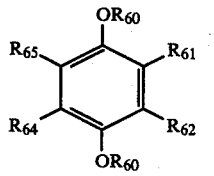
(XX)

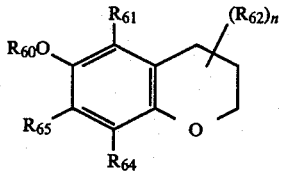
(XXI)

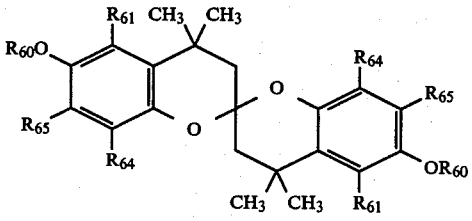
(XXII)

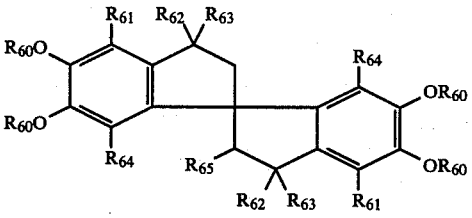
(XXIII)

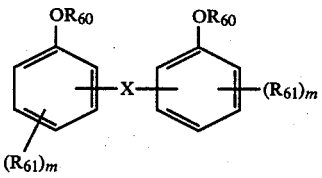
(XXIV)

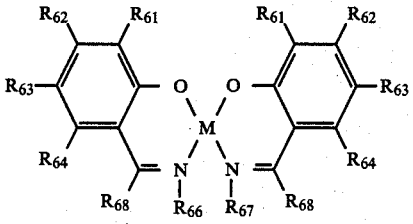
(XXV)

wherein $R_{60}$ represents a hydrogen atom, an aliphatic group, an aromatic group, a heterocyclic group, or a substituted silyl group represented by the formula:

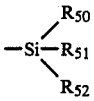

wherein $R_{50}$, $R_{51}$ and $R_{52}$ each represents a substituted or unsubstituted aliphatic group, a substituted or unsubstituted aromatic group, a substituted or unsubstituted aliphatic oxy group, or a substituted or unsubstituted aromatic oxy group; $R_{61}$, $R_{62}$, $R_{63}$, $R_{64}$, and $R_{65}$ each represents a hydrogen atom, a substituted or unsubstituted aliphatic group, a substituted or unsubstituted aromatic group, an acylamino group, a mono- or dialkylamino group, an aliphatic or aromatic thio group, an aliphatic or aromatic oxycarbonyl group or —$OR_{60}$; $R_{60}$ and $R_{61}$ together can form a 5- or 6-membered ring; $R_{61}$ and $R_{62}$ together can form a 5- or 6-membered ring; X represents a divalent linking group; $R_{66}$ and $R_{67}$ each represents a hydrogen atom, a substituted or unsubstituted aliphatic group, a substituted or unsubstituted aromatic ring or a hydroxyl group; $R_{68}$ represents a hydrogen atom, a substituted or unsubstituted aliphatic group or a substituted or unsubstituted aromatic ring; $R_{66}$ and $R_{67}$ together can form a 5- or 6-membered ring; M represents Cu, Co, Ni, Pd, or Pt; n represents 0 or an integer of from 1 to 6; m represents 0 or an integer of from 1 to 4; and when m or n is 2 or more, the substituted groups $R_{62}$ or $R_{61}$ may be the same or different.

23. A silver halide color photographic light-sensitive material as in claim 22, wherein X in the formula (XXIV) is

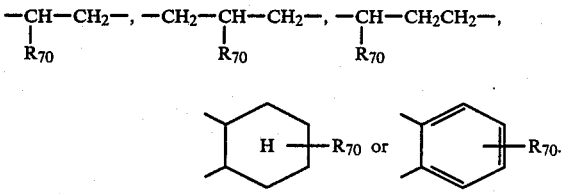

24. A silver halide color photographic light-sensitive material as in claim 22, wherein $R_{61}$ in the formula (XXV) is a group capable of forming a hydrogen bond.

25. A silver halide color photographic light-sensitive material as in claim 22, wherein at least one of $R_{62}$, $R_{63}$, and $R_{64}$ in the formula (XXIII) or (XXV) is a hydrogen atom, a hydroxyl group, an alkyl group, or an alkoxy group.

26. A silver halide color photographic light-sensitive material as in claim 22, wherein the discoloration inhibitor selected from the compounds represented by formulae (XX), (XXI), (XXII), (XXIII), and (XXIV) is used in an amount of from 10 to 200 mol% with respect to the amount of coupler represented by formula (III).

27. A silver halide color photographic light-sensitive material as in claim 22, wherein the discoloration inhibitor selected from the compounds represented by formulae (XX), (XXI), (XXII), (XXIII), and (XXIV) is used in an amount of from 30 to 100 mol% with respect to the amount of coupler represented by formula (III).

28. A silver halide color photographic light-sensitive material as in claim 22, wherein the discoloration inhibitor selected from the compounds represented by formula (XXV) is used in an amount of from 1 to 100 mol% with respect to the amount of coupler represented by formula (III).

29. A silver halide color photographic light-sensitive material as in claim 22, wherein the discoloration inhibitor selected from the compounds represented by formula (XXV) is used in an amount of from 5 to 40 mol% with respect to the amount of coupler represented by formula (III).

* * * * *